US009128443B2

(12) United States Patent
Leemhuis et al.

(10) Patent No.: US 9,128,443 B2
(45) Date of Patent: Sep. 8, 2015

(54) TONER LEVEL SENSING FOR REPLACEABLE UNIT OF AN IMAGE FORMING DEVICE

(71) Applicant: Lexmark International, Inc., Lexington, KY (US)

(72) Inventors: Michael Craig Leemhuis, Nicholasville, KY (US); Jeffrey Alan Abler, Georgetown, KY (US); Charles Alan Bast, Winchester, KY (US); Todd Alan Dutton, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 14/227,131

(22) Filed: Mar. 27, 2014

(65) Prior Publication Data

US 2014/0205305 A1 Jul. 24, 2014

Related U.S. Application Data

(63) Continuation-in-part of application No. 14/013,457, filed on Aug. 29, 2013, which is a continuation-in-part of application No. 13/717,908, filed on Dec. 18, 2012, now Pat. No. 8,989,611.

(51) Int. Cl.
*G03G 15/08* (2006.01)
*G03G 15/00* (2006.01)

(52) U.S. Cl.
CPC ..... *G03G 15/556* (2013.01); *G03G 15/086* (2013.01); *G03G 15/0831* (2013.01); *G03G 15/0856* (2013.01); *G03G 2215/0802* (2013.01)

(58) Field of Classification Search
CPC ..... G03G 15/0831; G03G 15/086; G03G 15/0856; G03G 2215/0802
See application file for complete search history.

(56) References Cited

U.S. PATENT DOCUMENTS 4,506,804 A 3/1985 Oka
4,989,754 A 2/1991 Grasso et al.

(Continued)

FOREIGN PATENT DOCUMENTS

JP 2002-108086 A 4/2002
JP 3351179 B2 11/2002
WO 2012144324 A1 10/2012

OTHER PUBLICATIONS

Prosecution history of U.S. Appl. No. 13/717,908 including Non-Final Office Action dated Jul. 18, 2014.

(Continued)

*Primary Examiner* — G. M. Hyder
(74) *Attorney, Agent, or Firm* — Justin M Tromp

(57) ABSTRACT

A method for estimating an amount of toner remaining in a reservoir of a replaceable unit for an image forming device according to one example embodiment includes rotating a shaft positioned in the reservoir and measuring an amount of revolution of the shaft. A paddle mounted on the shaft and free to fall ahead of the rotation of the shaft is pushed by the rotation of the shaft. An estimate of the amount of toner remaining in the reservoir is decreased based on the measured amount of revolution of the shaft. The paddle is sensed near a lowest center of gravity of the paddle. The estimate of the amount of toner remaining in the reservoir is adjusted when the number of times the paddle is sensed near the lowest center of gravity of the paddle per revolution of the shaft increases.

20 Claims, 16 Drawing Sheets

(56) References Cited

U.S. PATENT DOCUMENTS

| | | | |
|---|---|---|---|
| 5,111,247 | A | 5/1992 | Nichols |
| 5,216,462 | A | 6/1993 | Nakajima et al. |
| 5,237,372 | A | 8/1993 | Ishii et al. |
| 5,383,007 | A | 1/1995 | Kinoshita et al. |
| 5,436,704 | A | 7/1995 | Moon |
| 5,587,770 | A | 12/1996 | Jo et al. |
| 5,634,169 | A | 5/1997 | Barry et al. |
| 5,995,772 | A | 11/1999 | Barry et al. |
| 6,032,004 | A | 2/2000 | Mirabella, Jr. et al. |
| 6,100,601 | A | 8/2000 | Baker et al. |
| 6,246,841 | B1 | 6/2001 | Merrifield et al. |
| 6,336,015 | B1 | 1/2002 | Numagami |
| 6,343,883 | B1 | 2/2002 | Tada et al. |
| 6,459,876 | B1 | 10/2002 | Buchanan et al. |
| 6,496,662 | B1 | 12/2002 | Buchanan et al. |
| 6,510,291 | B2 | 1/2003 | Campbell et al. |
| 6,546,213 | B2 | 4/2003 | Ito et al. |
| 6,580,881 | B2 | 6/2003 | Coriale et al. |
| 6,600,882 | B1 | 7/2003 | Applegate et al. |
| 6,654,569 | B2 | 11/2003 | Nozawa |
| 6,718,147 | B1 | 4/2004 | Carter et al. |
| 6,819,884 | B1 | 11/2004 | Carter et al. |
| 7,103,308 | B2 | 9/2006 | Wakana |
| 7,139,505 | B2 | 11/2006 | Askren et al. |
| 7,177,567 | B2 | 2/2007 | Miller |
| 7,187,876 | B2 | 3/2007 | Ito et al. |
| 7,231,153 | B2 | 6/2007 | May |
| 7,248,806 | B2 | 7/2007 | Askren et al. |
| 7,399,074 | B2 | 7/2008 | Aldrich et al. |
| 7,551,862 | B2 | 6/2009 | Tanaka et al. |
| 7,555,231 | B2 | 6/2009 | Etter et al. |
| 7,782,198 | B2 | 8/2010 | Crockett et al. |
| 8,208,836 | B2 | 6/2012 | Shimomura |
| 8,718,496 | B2 | 5/2014 | Barry et al. |
| 2001/0051051 | A1 | 12/2001 | Matsumoto |
| 2002/0091413 | A1 | 7/2002 | Cappa et al. |
| 2002/0168192 | A1 | 11/2002 | Surya et al. |
| 2006/0198643 | A1 | 9/2006 | Kimura et al. |
| 2006/0291910 | A1 | 12/2006 | Choi et al. |
| 2007/0196137 | A1 | 8/2007 | Hebner et al. |
| 2008/0226351 | A1 | 9/2008 | Dawson et al. |
| 2009/0185833 | A1 | 7/2009 | Shimomura |
| 2010/0202798 | A1 | 8/2010 | Suzuki et al. |
| 2010/0303484 | A1 | 12/2010 | Hogan et al. |
| 2011/0206391 | A1 | 8/2011 | Naruse |
| 2012/0045224 | A1 | 2/2012 | Amann et al. |
| 2012/0070162 | A1 | 3/2012 | Barry |
| 2012/0099900 | A1 | 4/2012 | Noguchi et al. |
| 2012/0170948 | A1 | 7/2012 | Kwon et al. |
| 2013/0004208 | A1 | 1/2013 | Shimomura |
| 2013/0039670 | A1 | 2/2013 | Hosoya et al. |
| 2013/0202275 | A1 | 8/2013 | Brown et al. |
| 2013/0257455 | A1 | 10/2013 | Ahne et al. |
| 2013/0343777 | A1 | 12/2013 | Amann et al. |
| 2014/0029960 | A1 | 1/2014 | Ahne et al. |
| 2014/0079438 | A1 | 3/2014 | Abler et al. |
| 2014/0105619 | A1 | 4/2014 | Elliott et al. |
| 2014/0105620 | A1 | 4/2014 | Elliott et al. |
| 2014/0105622 | A1 | 4/2014 | True et al. |
| 2014/0169806 | A1 | 6/2014 | Leemhuis et al. |
| 2014/0169807 | A1 | 6/2014 | Leemhuis et al. |
| 2014/0169808 | A1 | 6/2014 | Leemhuis et al. |
| 2014/0169810 | A1 | 6/2014 | Leemhuis et al. |

OTHER PUBLICATIONS

Prosecution history of U.S. Appl. No. 13/717,923 including Non-Final Office Action dated Aug. 19, 2014.

International Search Report and Written Opinion of the International Searching Authority for PCT Application No. PCT/US2013/075569 dated Apr. 23, 2014.

International Search Report and Written Opinion of the International Searching Authority for PCT Application No. PCT/US2013/075573 dated Apr. 23, 2014.

International Search Report and Written Opinion of the International Searching Authority for PCT Application No. PCT/US2013/075575 dated Apr. 16, 2014.

Prosecution history of U.S. Appl. No. 13/717,908 including Notice of Allowance dated Apr. 11, 2014.

Prosecution history of U.S. Appl. No. 13/717,908 including Notice of Allowance dated Nov. 14, 2014.

Prosecution history of U.S. Appl. No. 13/013,457 including Non-Final Office Action dated Feb. 5, 2015.

Prosecution history of U.S. Appl. No. 13/717,923 including Notice of Allowance dated Jan. 30, 2015.

Prosecution history of U.S. Appl. No. 14/107,487 including Notice of Allowance dated Feb. 11, 2015.

U.S. Appl. No. 14/227,117, filed Mar. 27, 2014.

U.S. Appl. No. 14/254,178, filed Apr. 16, 2014.

U.S. Appl. No. 14/257,074, filed Apr. 21, 2014.

Machine translation of JP 2002-108086A obtained on May 8, 2015.

Notice of Allowance mailed Apr. 1, 2015 for U.S. Appl. No. 14/227,117.

TONER LEVEL SENSING FOR REPLACEABLE UNIT OF AN IMAGE FORMING DEVICE

CROSS REFERENCES TO RELATED APPLICATIONS

This patent application is a continuation-in-part application of U.S. patent application Ser. No. 14/013,457, filed Aug. 29, 2013, entitled "Rotational Sensing for a Replaceable Unit of an Image Forming Device," which is a continuation-in-part application of U.S. patent application Ser. No. 13/717,908, filed Dec. 18, 2012, entitled "Replaceable Unit for an Image Forming Device Having a Falling Paddle for Toner Level Sensing."

BACKGROUND

1. Field of the Disclosure

The present disclosure relates generally to image forming devices and more particularly to toner level sensing for a replaceable unit of an image forming device.

2. Description of the Related Art

During the electrophotographic printing process, an electrically charged rotating photoconductive drum is selectively exposed to a laser beam. The areas of the photoconductive drum exposed to the laser beam are discharged creating an electrostatic latent image of a page to be printed on the photoconductive drum. Toner particles are then electrostatically picked up by the latent image on the photoconductive drum creating a toned image on the drum. The toned image is transferred to the print media (e.g., paper) either directly by the photoconductive drum or indirectly by an intermediate transfer member. The toner is then fused to the media using heat and pressure to complete the print.

The image forming device's toner supply is typically stored in one or more replaceable units installed in the image forming device. As these replaceable units run out of toner, the units must be replaced or refilled in order to continue printing. As a result, it is desired to measure the amount of toner remaining in these units in order to warn the user that one of the replaceable units is near an empty state or to prevent printing after one of the units is empty in order to prevent damage to the image forming device. Accordingly, a system for measuring the amount of toner remaining in a replaceable unit of an image forming device is desired.

SUMMARY

A method for estimating an amount of toner remaining in a reservoir of a replaceable unit for an image forming device according to one example embodiment includes rotating a shaft positioned in the reservoir and measuring an amount of revolution of the shaft. A paddle mounted on the shaft and free to fall ahead of the rotation of the shaft is pushed by the rotation of the shaft. An estimate of the amount of toner remaining in the reservoir is decreased based on the measured amount of revolution of the shaft. The paddle is sensed near a lowest center of gravity of the paddle and processing circuitry monitors whether a number of times the paddle is sensed near the lowest center of gravity of the paddle per revolution of the shaft increases. The estimate of the amount of toner remaining in the reservoir is adjusted when the number of times the paddle is sensed near the lowest center of gravity of the paddle per revolution of the shaft increases.

An electrophotographic image forming device according to one example embodiment includes a drive motor and a replaceable unit. The replaceable unit has a reservoir for storing toner, a rotatable shaft positioned within the reservoir, and a paddle mounted on the shaft and free to fall ahead of the rotation of the shaft. The replaceable unit also includes a drive element positioned to receive rotational force from the drive motor when the replaceable unit is installed in the image forming device and operatively connected to the shaft to rotate the shaft upon receiving the rotational force from the drive motor. A sensor is positioned to sense the paddle near a lowest center of gravity of the paddle. A processor in electronic communication with the sensor is programmed to measure an amount of revolution of the shaft, decrease an estimate of the amount of toner remaining in the reservoir based on the measured amount of revolution of the shaft, monitor whether a number of times the paddle is sensed by the sensor near the lowest center of gravity of the paddle per revolution of the shaft increases, and adjust the estimate of the amount of toner remaining in the reservoir when the number of times the paddle is sensed by the sensor near the lowest center of gravity of the paddle per revolution of the shaft increases.

A controller for use with an image forming device for estimating an amount of toner remaining in a reservoir of a replaceable unit of the image forming device according to one example embodiment includes the controller programmed to measure an amount of revolution of a shaft in the reservoir of the replaceable unit, to decrease an estimate of the amount of toner remaining in the reservoir based on the measured amount of revolution of the shaft, to monitor whether a number of times a paddle mounted on the shaft in the reservoir is sensed near a lowest center of gravity of the paddle per revolution of the shaft increases, and to adjust the estimate of the amount of toner remaining in the reservoir when the number of times the paddle is sensed near the lowest center of gravity of the paddle per revolution of the shaft increases.

A controller for use with an image forming device for estimating an amount of toner remaining in a reservoir of a replaceable unit of the image forming device according to another example embodiment includes the controller programmed to receive pulses from a sensor of an encoder device measuring rotation of a drive motor that provides rotational motion to a shaft in the reservoir of the replaceable unit when the replaceable unit is installed in the image forming device, to decrement an estimate of the number pulses from the sensor remaining until the reservoir will run out of useable toner for each pulse received from the sensor, and to monitor whether the shaft in the reservoir of the replaceable unit has completed a revolution based on the number of pulses received from the sensor. When the controller determines that the shaft in the reservoir of the replaceable unit has completed a revolution, the controller is programmed to send a request to a processor of the replaceable unit for a count of a number of passes of a paddle in the reservoir of the replaceable unit near a lowest center of gravity of the paddle during the completed revolution of the shaft and to receive from the processor of the replaceable unit the count of the number of passes of the paddle in the reservoir of the replaceable unit near the lowest center of gravity of the paddle during the completed revolution of the shaft. The controller is further programmed to determine whether the count of the number of passes of the paddle in the reservoir of the replaceable unit near the lowest center of gravity of the paddle per revolution of the shaft has increased and to adjust the estimate of the number pulses from the sensor remaining until the reservoir will run out of useable toner when the count of the number of passes of the paddle in the reservoir of the replaceable unit near the lowest center of gravity of the paddle per revolution of the shaft increases.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
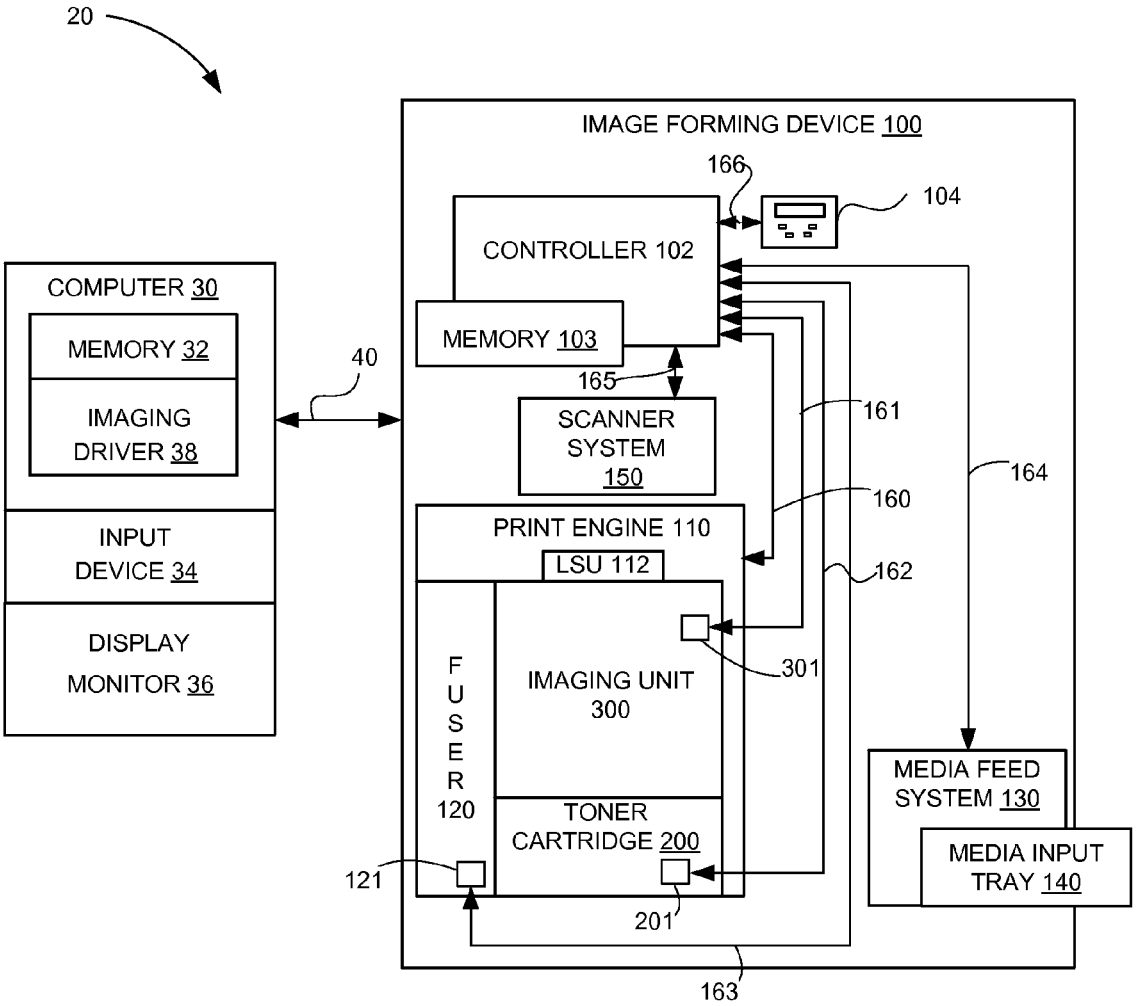
FIG. 1 is a block diagram depiction of an imaging system according to one example embodiment.

Referring now to the drawings and more particularly to FIG. 1, there is shown a block diagram depiction of an imaging system 20 according to one example embodiment. Imaging system 20 includes an image forming device 100 and a computer 30. Image forming device 100 communicates with computer 30 via a communications link 40. As used herein, the term "communications link" generally refers to any structure that facilitates electronic communication between multiple components and may operate using wired or wireless technology and may include communications over the Internet.

In the example embodiment shown in FIG. 1, image forming device 100 is a multifunction machine (sometimes referred to as an all-in-one (AIO) device) that includes a controller 102, a print engine 110, a laser scan unit (LSU) 112, one or more toner bottles or cartridges 200, one or more imaging units 300, a fuser 120, a user interface 104, a media feed system 130 and media input tray 140 and a scanner system 150. Image forming device 100 may communicate with computer 30 via a standard communication protocol, such as, for example, universal serial bus (USB), Ethernet or IEEE 802.xx. Image forming device 100 may be, for example, an electrophotographic printer/copier including an integrated scanner system 150 or a standalone electrophotographic printer.

Controller 102 includes a processor unit and associated memory 103 and may be formed as one or more Application Specific Integrated Circuits (ASICs). Memory 103 may be any volatile or non-volatile memory or combination thereof such as, for example, random access memory (RAM), read only memory (ROM), flash memory and/or non-volatile RAM (NVRAM). Alternatively, memory 103 may be in the form of a separate electronic memory (e.g., RAM, ROM, and/or NVRAM), a hard drive, a CD or DVD drive, or any memory device convenient for use with controller 102. Controller 102 may be, for example, a combined printer and scanner controller.

In the example embodiment illustrated, controller 102 communicates with print engine 110 via a communications link 160. Controller 102 communicates with imaging unit(s) 300 and processing circuitry 301 on each imaging unit 300 via communications link(s) 161. Controller 102 communicates with toner cartridge(s) 200 and processing circuitry 201 on each toner cartridge 200 via communications link(s) 162. Controller 102 communicates with fuser 120 and processing circuitry 121 thereon via a communications link 163. Controller 102 communicates with media feed system 130 via a communications link 164. Controller 102 communicates with scanner system 150 via a communications link 165. User interface 104 is communicatively coupled to controller 102 via a communications link 166. Processing circuitry 121, 201, 301 may each include a processor and associated memory such as RAM, ROM, and/or NVRAM and may provide authentication functions, safety and operational interlocks, operating parameters and usage information related to fuser 120, toner cartridge(s) 200 and imaging unit(s) 300, respectively. Processing circuitry 121, 201 and 301 may each include one or more ASICs. Controller 102 processes print and scan data and operates print engine 110 during printing and scanner system 150 during scanning.

Computer 30, which is optional, may be, for example, a personal computer, including memory 32, such as RAM, ROM, and/or NVRAM, an input device 34, such as a keyboard and/or a mouse, and a display monitor 36. Computer 30 also includes a processor, input/output (I/O) interfaces, and may include at least one mass data storage device, such as a hard drive, a CD-ROM and/or a DVD unit (not shown). Computer 30 may also be a device capable of communicating with image forming device 100 other than a personal computer such as, for example, a tablet computer, a smartphone, or other electronic device.

In the example embodiment illustrated, computer 30 includes in its memory a software program including program instructions that function as an imaging driver 38, e.g., printer/scanner driver software, for image forming device 100. Imaging driver 38 is in communication with controller 102 of image forming device 100 via communications link 40. Imaging driver 38 facilitates communication between image forming device 100 and computer 30. One aspect of imaging driver 38 may be, for example, to provide formatted print data to image forming device 100, and more particularly to print engine 110, to print an image. Another aspect of imaging driver 38 may be, for example, to facilitate the collection of scanned data from scanner system 150.

In some circumstances, it may be desirable to operate image forming device 100 in a standalone mode. In the standalone mode, image forming device 100 is capable of functioning without computer 30. Accordingly, all or a portion of imaging driver 38, or a similar driver, may be located in controller 102 of image forming device 100 so as to accommodate printing and/or scanning functionality when operating in the standalone mode.

Figure 2:
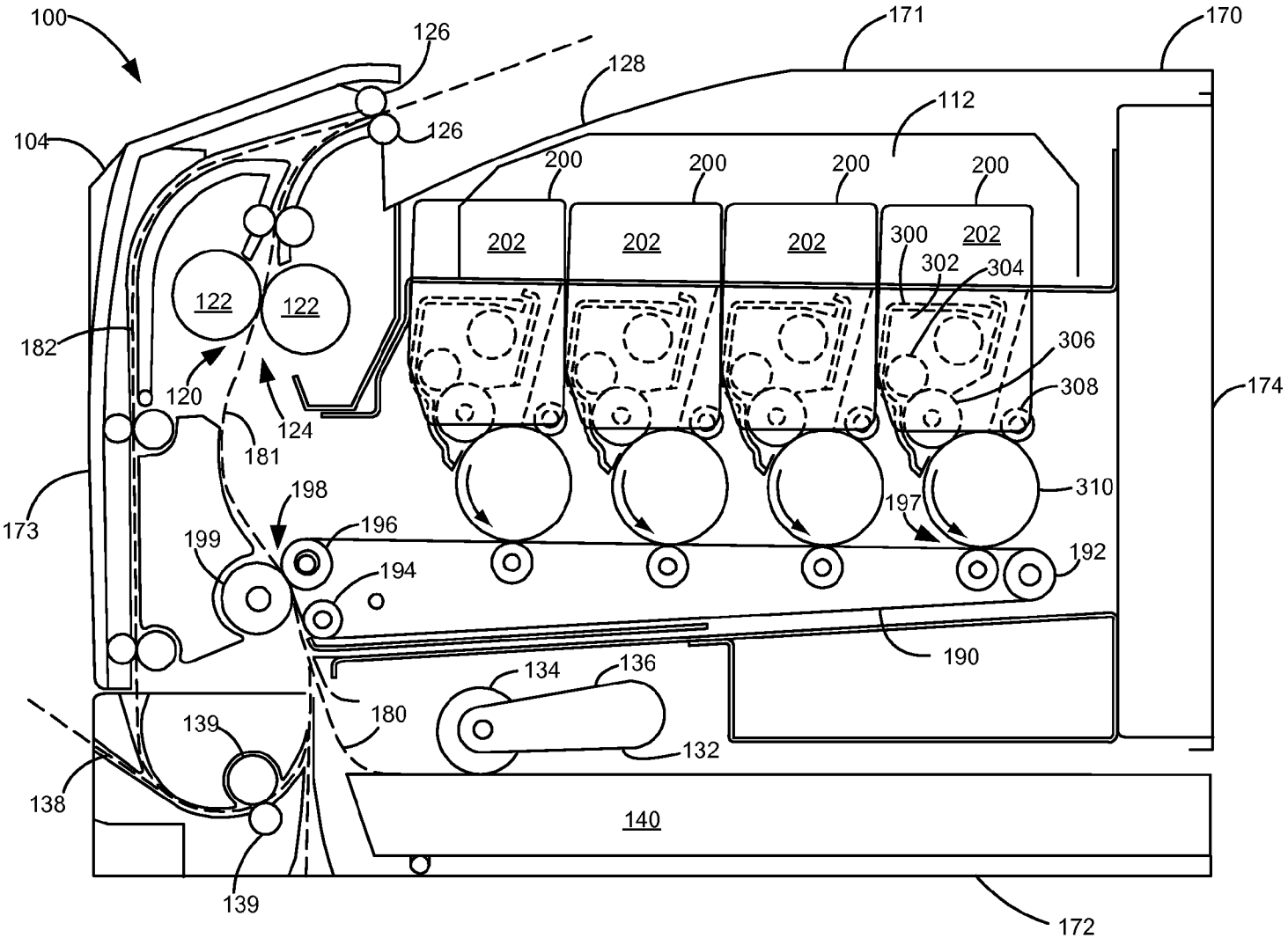
FIG. 2 is a schematic diagram of an image forming device according to a first example embodiment.

FIG. 2 illustrates a schematic view of the interior of an example image forming device 100. Image forming device 100 includes a housing 170 having a top 171, bottom 172, front 173 and rear 174. Housing 170 includes one or more media input trays 140 positioned therein. Trays 140 are sized to contain a stack of media sheets. As used herein, the term media is meant to encompass not only paper but also labels, envelopes, fabrics, photographic paper or any other desired substrate. Trays 140 are preferably removable for refilling. User interface 104 is shown positioned on housing 170. Using user interface 104, a user is able to enter commands and generally control the operation of the image forming device 100. For example, the user may enter commands to switch modes (e.g., color mode, monochrome mode), view the number of pages printed, etc. A media path 180 extends through image forming device 100 for moving the media sheets through the image transfer process. Media path 180 includes a simplex path 181 and may include a duplex path 182. A media sheet is introduced into simplex path 181 from tray 140 by a pick mechanism 132. In the example embodiment shown, pick mechanism 132 includes a roll 134 positioned at the end of a pivotable arm 136. Roll 134 rotates to move the media sheet from tray 140 and into media path 180. The media sheet is then moved along media path 180 by various transport rollers. Media sheets may also be introduced into media path 180 by a manual feed 138 having one or more rolls 139.

In the example embodiment shown, image forming device 100 includes four toner cartridges 200 removably mounted in housing 170 in a mating relationship with four corresponding imaging units 300 also removably mounted in housing 170. Each toner cartridge 200 includes a reservoir 202 for holding toner and an outlet port in communication with an inlet port of its corresponding imaging unit 300 for transferring toner from reservoir 202 to imaging unit 300. Toner is transferred periodically from a respective toner cartridge 200 to its corresponding imaging unit 300 in order to replenish the imaging unit 300. These periodic transfers are referred to as toner addition cycles and may occur during a print operation and/or between print operations. In the example embodiment illustrated, each toner cartridge 200 is substantially the same except for the color of toner contained therein. In one embodiment, the four toner cartridges 200 include yellow, cyan, magenta and black toner, respectively. Each imaging unit 300 includes a toner reservoir 302 and a toner adder roll 304 that moves toner from reservoir 302 to a developer roll 306. Each imaging unit 300 also includes a charging roll 308 and a photoconductive (PC) drum 310. PC drums 310 are mounted substantially parallel to each other when the imaging units 300 are installed in image forming device 100. For purposes of clarity, the components of only one of the imaging units 300 are labeled in FIG. 2. In the example embodiment illustrated, each imaging unit 300 is substantially the same except for the color of toner contained therein.

Each charging roll 308 forms a nip with the corresponding PC drum 310. During a print operation, charging roll 308 charges the surface of PC drum 310 to a specified voltage such as, for example, −1000 volts. A laser beam from LSU 112 is then directed to the surface of PC drum 310 and selectively discharges those areas it contacts to form a latent image. In one embodiment, areas on PC drum 310 illuminated by the laser beam are discharged to approximately −300 volts. Developer roll 306, which forms a nip with the corresponding PC drum 310, then transfers toner to PC drum 310 to form a toner image on PC drum 310. A metering device such as a doctor blade assembly can be used to meter toner onto developer roll 306 and apply a desired charge on the toner prior to its transfer to PC drum 310. The toner is attracted to the areas of the surface of PC drum 310 discharged by the laser beam from LSU 112.

An intermediate transfer mechanism (ITM) 190 is disposed adjacent to the PC drums 310. In this embodiment, ITM 190 is formed as an endless belt trained about a drive roll 192, a tension roll 194 and a back-up roll 196. During image forming operations, ITM 190 moves past PC drums 310 in a clockwise direction as viewed in FIG. 2. One or more of PC drums 310 apply toner images in their respective colors to ITM 190 at a first transfer nip 197. In one embodiment, a positive voltage field attracts the toner image from PC drums 310 to the surface of the moving ITM 190. ITM 190 rotates and collects the one or more toner images from PC drums 310 and then conveys the toner images to a media sheet at a second transfer nip 198 formed between a transfer roll 199 and ITM 190, which is supported by back-up roll 196.

A media sheet advancing through simplex path 181 receives the toner image from ITM 190 as it moves through the second transfer nip 198. The media sheet with the toner image is then moved along the media path 180 and into fuser 120. Fuser 120 includes fusing rolls or belts 122 that form a nip 124 to adhere the toner image to the media sheet. The fused media sheet then passes through exit rolls 126 located downstream from fuser 120. Exit rolls 126 may be rotated in either forward or reverse directions. In a forward direction, exit rolls 126 move the media sheet from simplex path 181 to an output area 128 on top 171 of image forming device 100. In a reverse direction, exit rolls 126 move the media sheet into duplex path 182 for image formation on a second side of the media sheet.

Figure 3:
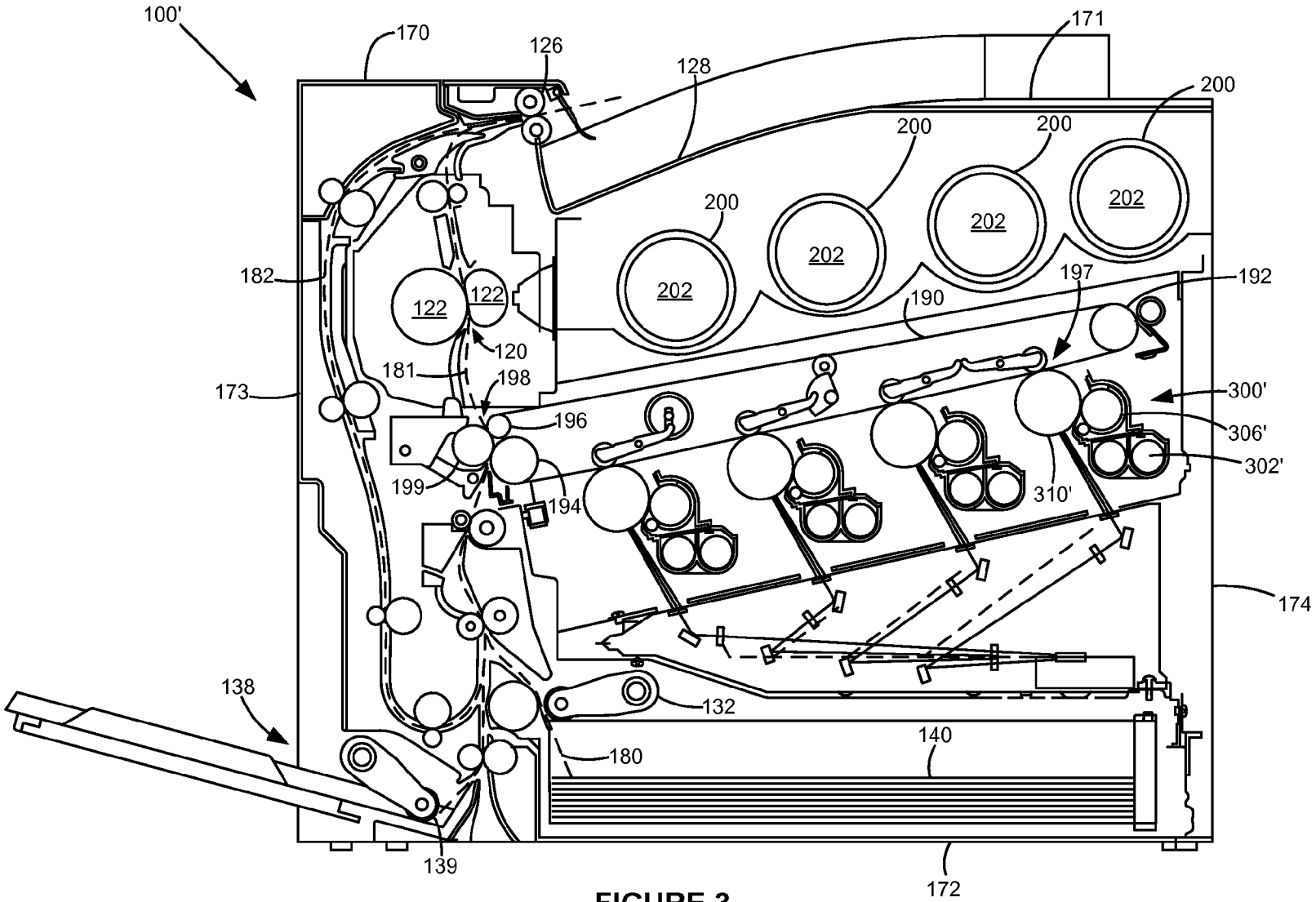
FIG. 3 is a schematic diagram of an image forming device according to a second example embodiment.

FIG. 3 illustrates an example embodiment of an image forming device 100' that utilizes what is commonly referred to as a dual component developer system. In this embodiment, image forming device 100' includes four toner cartridges 200 removably mounted in housing 170 and mated with four corresponding imaging units 300'. Toner is periodically transferred from reservoirs 202 of each toner cartridge 200 to corresponding reservoirs 302' of imaging units 300'. The toner in reservoirs 302' is mixed with magnetic carrier beads. The magnetic carrier beads may be coated with a polymeric film to provide triboelectric properties to attract toner to the carrier beads as the toner and the magnetic carrier beads are mixed in reservoir 302'. In this embodiment, each imaging unit 300' includes a magnetic roll 306' that attracts the magnetic carrier beads having toner thereon to magnetic roll 306' through the use of magnetic fields and transports the toner to the corresponding photoconductive drum 310'. Electrostatic forces from the latent image on the photoconductive drum 310' strip the toner from the magnetic carrier beads to provide a toned image on the surface of the photoconductive drum 310'. The toned image is then transferred to ITM 190 at first transfer nip 197 as discussed above.

While the example image forming devices 100 and 100' shown in FIGS. 2 and 3 illustrate four toner cartridges 200 and four corresponding imaging units 300, 300', it will be appreciated that a monocolor image forming device 100 or 100' may include a single toner cartridge 200 and corresponding imaging unit 300 or 300' as compared to a color image forming device 100 or 100' that may include multiple toner cartridges 200 and imaging units 300, 300'. Further, although image forming devices 100 and 100' utilize ITM 190 to transfer toner to the media, toner may be applied directly to the media by the one or more photoconductive drums 310, 310' as is known in the art.

Figure 4:
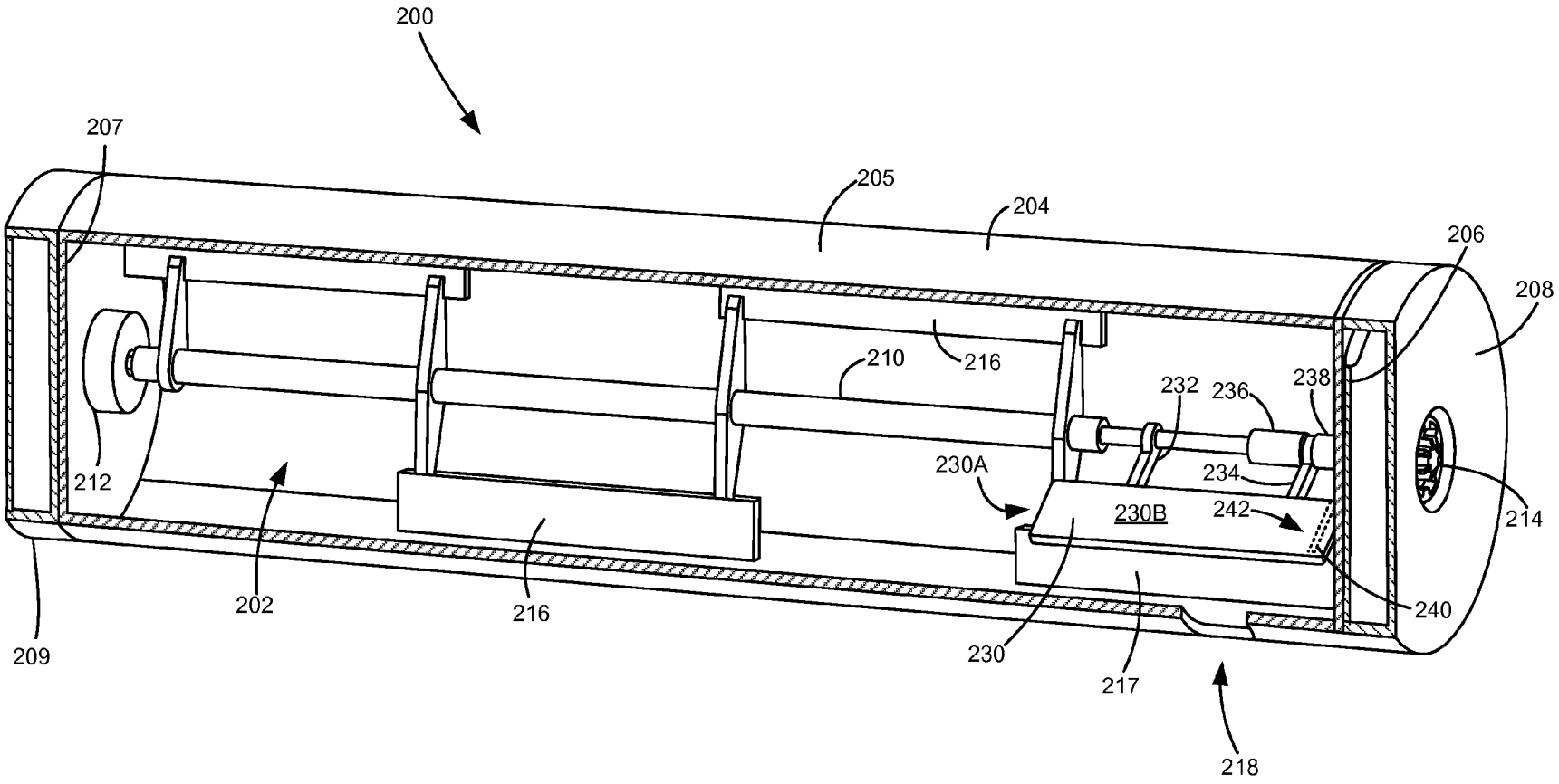
FIG. 4 is a perspective side view of a toner cartridge according to one example embodiment having a portion of a body of the toner cartridge removed to illustrate an internal toner reservoir.
Figure 5:
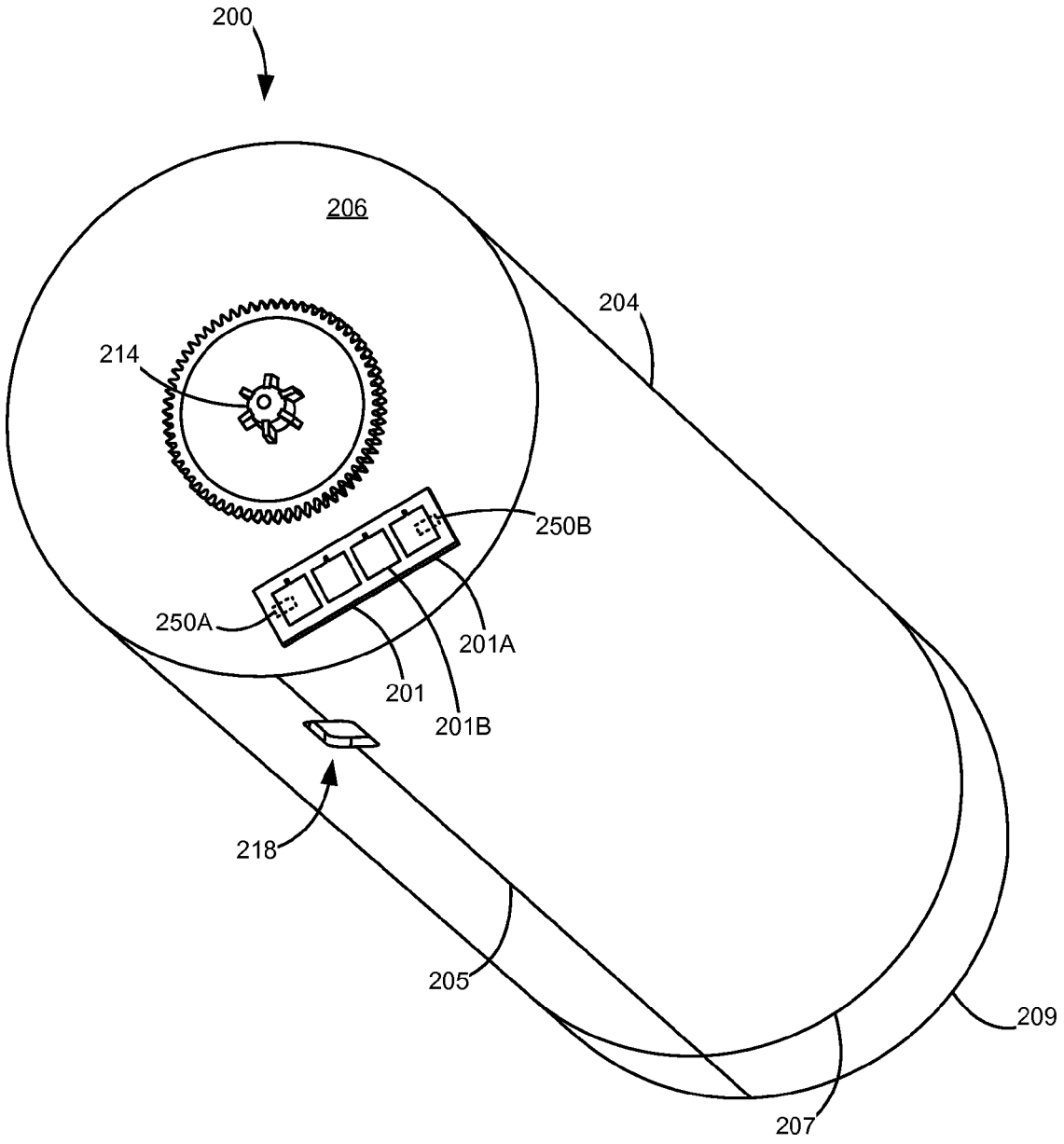
FIG. 5 is a perspective end view of the toner cartridge shown in FIG. 4.

With reference to FIGS. 4 and 5, toner cartridge 200 is shown according to one example embodiment. Toner cartridge 200 includes a body 204 that includes walls forming toner reservoir 202. In the example embodiment illustrated, body 204 includes a generally cylindrical wall 205 and a pair of end walls 206, 207. In this embodiment, end caps 208, 209 are mounted on end walls 206, 207, respectively, such as by suitable fasteners (e.g., screws, rivets, etc.) or by a snap-fit engagement. FIG. 4 shows toner cartridge 200 with a portion of body 204 removed to illustrate the internal components of toner cartridge 200. A rotatable shaft 210 extends along the length of toner cartridge 200 within toner reservoir 202. As desired, the ends of rotatable shaft 210 may be received in bushings or bearings 212 positioned on an inner surface of end walls 206, 207. A drive element 214, such as a gear or other form of drive coupler, is positioned on an outer surface of end wall 206. When toner cartridge 200 is installed in the image forming device, drive element 214 receives rotational force from a corresponding drive component in the image forming device to rotate shaft 210. Shaft 210 may be connected directly or by one or more intermediate gears to drive element 214. One or more agitators 216 (e.g., paddle(s), auger(s), etc.) may be mounted on and rotate with shaft 210 to stir and move toner within reservoir 202 as desired. In one embodiment, a flexible strip 220 (FIGS. 6A-6C), for example a polyethylene terephthalate (PET) material such as MYLAR® available from DuPont Teijin Films, Chester, Va., USA, may be connected to a distal end of agitator(s) 216 to sweep toner from the interior surface of one or more of walls 205, 206, 207.

An outlet port 218 is positioned on a bottom portion of body 204 such as near end wall 206. In the example embodiment shown, toner exiting reservoir 202 is moved directly into outlet port 218 by agitator(s) 216, which may be positioned to urge toner toward outlet port 218 in order to promote toner flow out of reservoir 202. In another embodiment, exiting toner is moved axially with respect to shaft 210 by a rotatable auger from an opening into reservoir 202, through a channel in wall 205 and out of outlet port 218. The rotatable auger may be connected directly or by one or more intermediate gears to drive element 214 in order to receive rotational force. Alternatively, the rotatable auger may be driven separately from shaft 210 using a second drive element to receive rotational force from the image forming device independently from shaft 210. As desired, outlet port 218 may include a shutter or a cover (not shown) that is movable between a closed position blocking outlet port 218 to prevent toner from flowing out of toner cartridge 200 and an open position permitting toner flow. Shaft 210 and the rotatable auger (if present) are rotated during each toner addition cycle to deliver toner from reservoir 202 through outlet port 218.

A paddle 230 is mounted on shaft 210 and is free to rotate on shaft 210. In other words, paddle 230 is rotatable independent of shaft 210. Paddle 230 is axially positioned next to end wall 206 but may be positioned elsewhere in reservoir 202 so long as a magnet 240 of paddle 230 is detectable by a magnetic sensor as discussed below. Paddle 230 is spaced from the interior surfaces of walls 205, 206, 207 so that walls 205, 206, 207 do not impede the motion of paddle 230. In the example embodiment illustrated, paddle 230 is axially positioned above the opening from outlet port 218 into reservoir 202 such that the rotational path of paddle 230 passes above the opening from outlet port 218 into reservoir 202. However, if the toner level for a particular design of reservoir 202 is substantially uniform, paddle 230 may be positioned elsewhere along shaft 210. Paddle 230 includes a pair of radial mounts 232, 234 each having an opening that receives shaft 210. Alternatively, paddle 230 may include one or more than two mounts. In the embodiment illustrated, stops 236, 238 are positioned on opposite axial sides of one or more of radial supports 232, 234 to limit the axial movement of paddle 230 along shaft 210.

Paddle 230 includes a magnet 240 that rotates with paddle 230 and has a magnetic field that is detectable by a magnetic sensor for determining an amount of toner remaining in reservoir 202 as discussed in greater detail below. In one embodiment, magnet 240 is positioned at an axially outermost portion of paddle 230 near end wall 206 in order to permit detection by a magnetic sensor on end wall 206 (either mounted directly on end wall 206 or indirectly on end wall 206, such as on end cap 208) or on a portion of the image forming device adjacent to end wall 206 when toner cartridge 200 is installed in the image forming device. In one embodiment, a pole of magnet 240 is directed toward the position of the magnetic sensor in order to facilitate the detection of magnet 240 by the magnetic sensor. The magnetic sensor may be configured to detect one of a north pole and a south pole of magnet 240 or both. Where the magnetic sensor detects one of a north pole and a south pole, magnet 240 may be positioned such that the detected pole is directed toward the magnetic sensor. In one embodiment, paddle 230 is composed of a non-magnetic material and magnet 240 is held by a friction fit in a cavity 242 in paddle 230. For example, paddle 230 may be formed of plastic overmolded around magnet 240. Magnet 240 may also be attached to paddle 230 using an adhesive or fastener(s) so long as magnet 240 will not dislodge from paddle 230 during operation of toner cartridge 200. Magnet 240 may be any suitable size and shape so as to be detectable by a magnetic sensor. For example, magnet 240 may be a cube, a rectangular, octagonal or other form of prism, a sphere or cylinder, a thin sheet or an amorphous object. In another embodiment, paddle 230 is composed of a magnetic material such that the body of paddle 230 forms the magnet 240. Magnet 240 may be composed of any suitable material such as steel, iron, nickel, etc. In one embodiment, body 204 and agitator 216 are composed of a non-magnetic material, such as plastic, so as not to attract magnet 240 and interfere with the motion of paddle 230.

Paddle 230 is axially aligned on shaft 210 with a driving member 217 mounted on shaft 210 such that paddle 230 is in the rotational path of driving member 217. In this manner, driving member 217 is able to push paddle 230 when shaft 210 rotates. In the example embodiment illustrated, an agitator 216 serves as driving member 217; however, a paddle or other form of extension from shaft 210 may serve as the driving member 217. In one embodiment, shaft 210 and driving member 217 rotate at a substantially constant rotational speed when driven by drive element 214. Driving member 217 pushes a rear surface 230A of paddle 230. Paddle 230 may include ribs or other predefined contact points on its rear surface 230A for engagement with driving member 217.

Figure 6A:
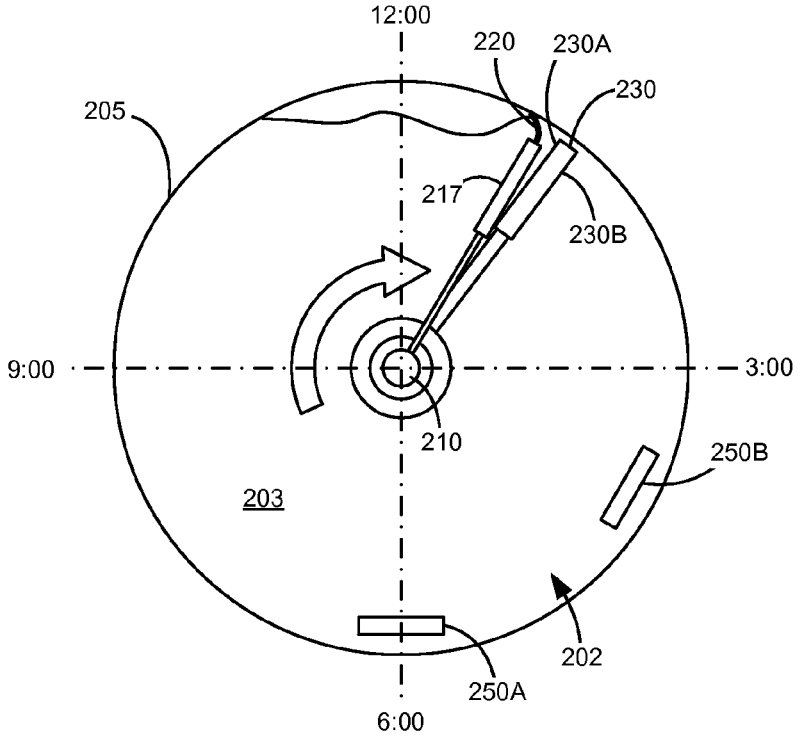
FIGS. 6A-C are schematic diagrams of a side view of the toner cartridge illustrating the operation of a falling paddle at various toner levels.
Figure 6B:
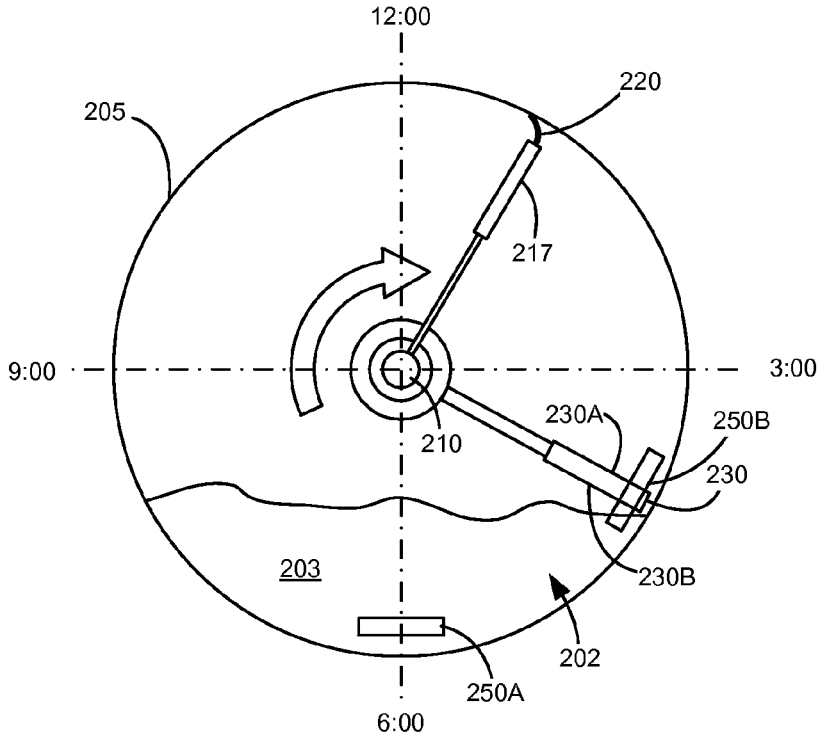
Figure 6C:
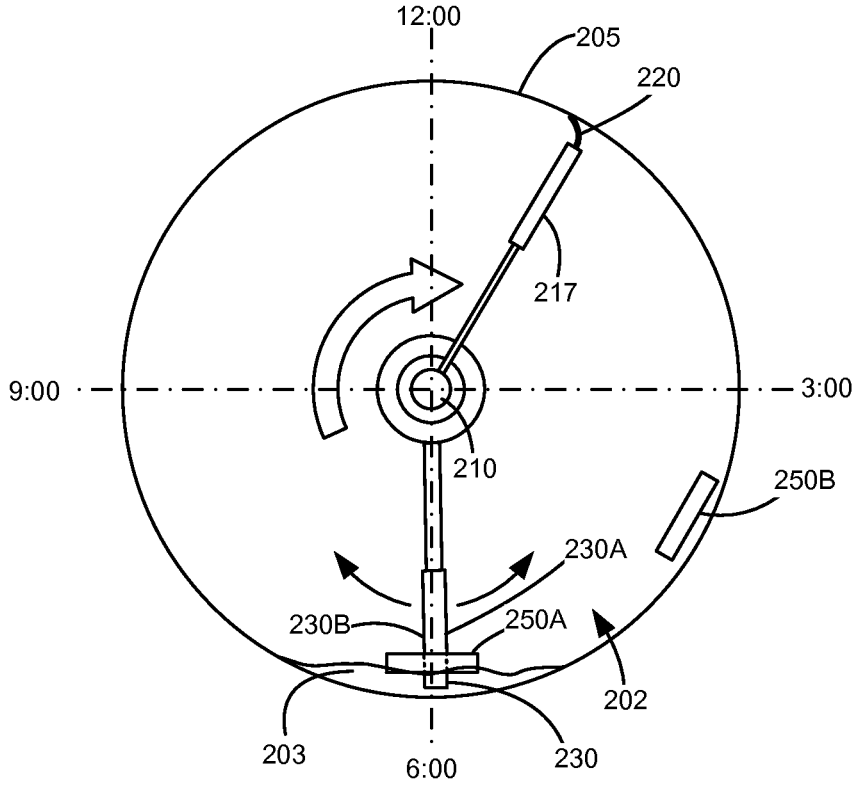

FIGS. 6A-6C schematically depict the relationship between paddle 230 and driving member 217. FIGS. 6A-6C depict a clock face in dashed lines along the rotational path of paddle 230 in order to aid in the description of the operation of paddle 230. When toner reservoir 202 is relatively full as depicted in FIG. 6A, toner 203 present in reservoir 202 prevents paddle 230 from rotating freely about shaft 210. Instead, paddle 230 is pushed through its rotational path by driving member 217 when shaft 210 rotates. As a result, when toner reservoir 202 is relatively full as shaft 210 rotates, the rotational motion of paddle 230 follows the rotational motion of driving member 217. Toner 203 prevents paddle 230 from advancing quicker than driving member 217.

As the toner level in reservoir 202 decreases as depicted in FIG. 6B, as paddle 230 is pushed through the upper vertical position of rotation (the "12 o'clock" position) by driving member 217, paddle 230 tends to separate from driving member 217 and fall faster (toward the "3 o'clock" position) than driving member 217 is being driven due to the weight of paddle 230. As a result, paddle 230 may be referred to as a falling paddle. Paddle 230 falls forward under its own weight until a front face 230B of paddle 230 contacts toner 203, which stops the rotational advance of paddle 230. In this manner, paddle 230 remains substantially stationary on top of (or slightly below the surface of) toner 203 until driving member 217 catches up with paddle 230. When driving member 217 advances and re-engages with rear surface 230A of paddle 230, driving member 217 resumes pushing paddle 230 through its rotational path.

When the toner level in reservoir 202 gets low as depicted in FIG. 6C, paddle 230 tends to fall forward away from driving member 217 as paddle passes the "12 o'clock" position and tends to swing all the way down to the lower vertical position of its rotational path (the "6 o'clock" position). Depending on how much toner 203 remains, paddle 230 may tend to oscillate back and forth in a pendulum manner about the "6 o'clock" position until driving member 217 catches up to resume pushing paddle 230. As a result, it will be appreciated that the rotational motion of paddle 230 relates to the amount of toner 203 remaining in reservoir 202. FIGS. 6A-6C show shaft 210 rotating in a clockwise direction when viewed from end wall 206; however, the direction of rotation may be reversed as desired.

Figure 7A:
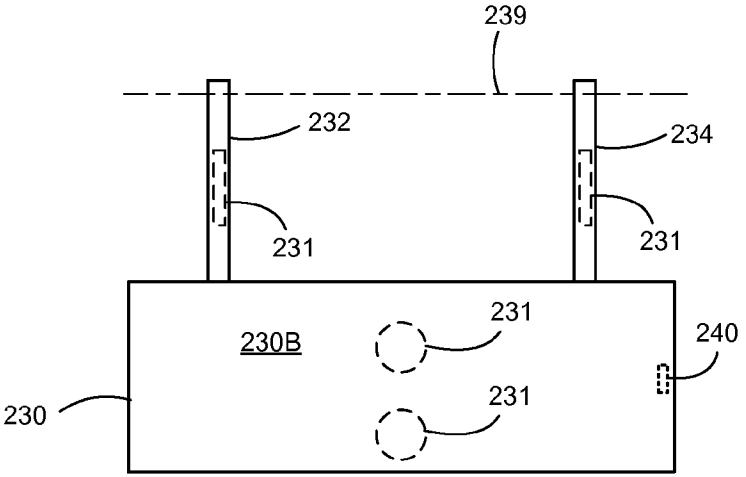
FIG. 7A is a front view of a paddle according to a first example embodiment.
Figure 7B:
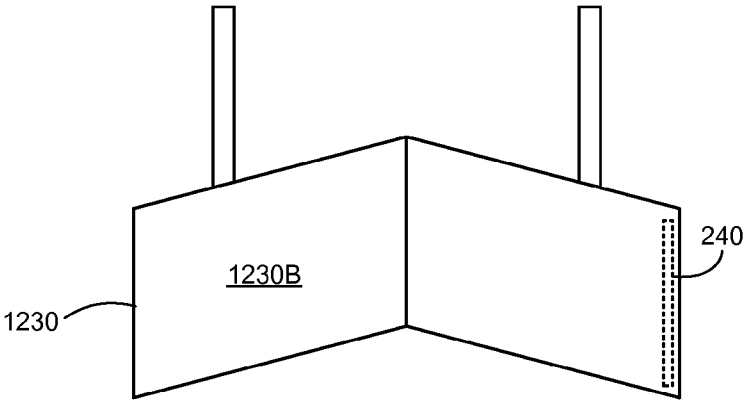
FIG. 7B is a front view of a paddle according to a second example embodiment.
Figure 7C:
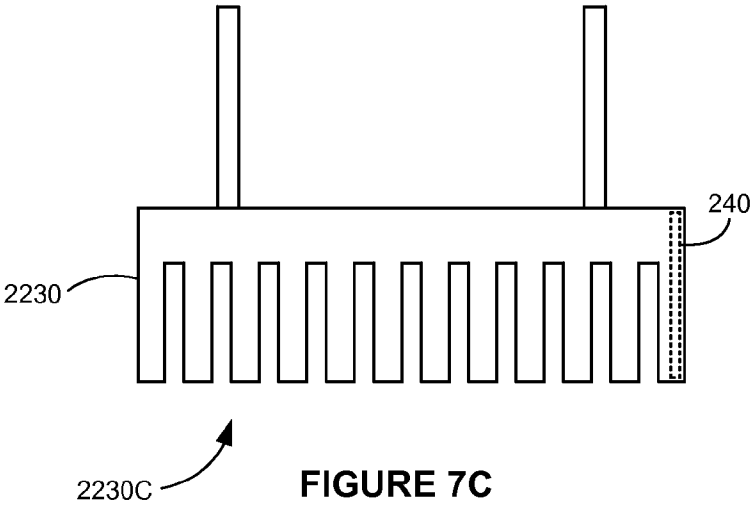
FIG. 7C is a front view of a paddle according to a third example embodiment.
Figure 7D:
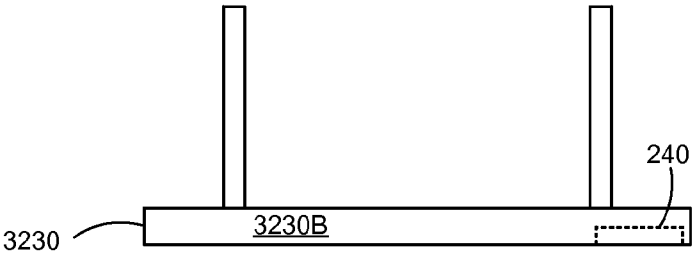
FIG. 7D is a front view of a paddle according to a fourth example embodiment.

Paddle 230 has minimal rotational friction other than its interaction with toner 203 in reservoir 202. As a result, shaft 210 provides radial support for paddle 230 but does not impede the rotational movement of paddle 230. Paddle 230 may be weighted as desired in order to alter its rotational movement. Paddle 230 may take many shapes and sizes as desired. For example, FIG. 7A illustrates the paddle 230 shown in FIGS. 4 and 5. In this embodiment, front face 230B of paddle 230 is substantially planar and normal to the direction of motion of paddle 230 (parallel to shaft 210) to allow front face 230B of paddle 230 to strike toner 203 as paddle 230 falls. In an alternative embodiment, front face 230B of paddle 230 is angled with respect to the direction of motion of paddle 230 (angled with respect to shaft 210). As shown in FIG. 7A, paddle 230 may include one or more weights 231 mounted on paddle 230 and positioned relative to an axis of rotation 239 of paddle 230 as desired to control the rotational movement of paddle 230. FIG. 7B illustrates a V-shaped paddle 1230 having a front face 1230B forming a concave portion of the V-shaped profile for directing toner 203 away from end wall 206 and into outlet port 218. FIG. 7C illustrates a paddle 2230 having a comb portion 2230C for decreasing the friction between paddle 2230 and toner 203. FIG. 7D illustrates a paddle 3230 having a front face 3230B having a smaller surface area as compared with front face 230B of paddle 230 in order to reduce the drag through toner 203.

One or more magnetic sensors 250 positioned on end wall 206 of toner cartridge 200 or positioned in a portion of the image forming device adjacent to end wall 206 when toner cartridge 200 is installed in the image forming device may be used to determine the amount of toner 203 remaining in reservoir 202 by sensing the motion of paddle 230 as shaft 210 rotates. Magnetic sensor(s) 250 may be any suitable device capable of detecting the presence or absence of a magnetic field. For example, magnetic sensor(s) 250 may be a hall-effect sensor, which is a transducer that varies its electrical output in response to a magnetic field. Two magnetic sensors 250A, 250B are depicted in FIGS. 6A-6C. A first magnetic sensor 250A is aligned at or near the lowest center of gravity of paddle 230 to sense the presence of magnet 240 near where paddle 230 oscillates when the toner level in reservoir 202 is low. Accordingly, in one embodiment, magnetic sensor 250A is positioned between about the "5 o'clock" position and about the "7 o'clock" position, such as at about the "6 o'clock" position as shown. An optional second magnetic sensor 250B is positioned between about the "2 o'clock" position and about the "5 o'clock" position. In the example embodiment illustrated, magnetic sensor 250B is positioned at about the "4 o'clock" position. More than two magnetic sensors 250 may also be used as desired.

With reference to FIG. 5, magnetic sensor(s) 250A, 250B may be mounted on end wall 206 (either directly on the outer surface of end wall 206 or indirectly on end wall 206, such as on end cap 208). In this embodiment, magnetic sensor(s) 250A, 250B are in electronic communication with processing circuitry 201 of toner cartridge 200. In the example embodiment illustrated, magnetic sensor(s) 250A, 250B (shown in dashed lines) are mounted on a rear side of an electronic module such as a flex circuit or a printed circuit board (PCB) 201A having processing circuitry 201 of toner cartridge 200 thereon. In the embodiment illustrated, PCB 201A is mounted on an outer surface of end wall 206. PCB 201A contains one or more electrical contacts 201B on a front side of PCB 201A that contact corresponding electrical contact(s) in the image forming device when toner cartridge 200 is installed in the image forming device to facilitate communication with controller 102. Magnetic sensor(s) 250A, 250B may be positioned on other portions of body 204 as desired so long as magnetic sensor(s) 250A, 250B are able to detect the presence of magnet 240 of paddle 230 at a point in the rotational path of paddle 230. For example, in another embodiment, magnet 240 is positioned along the outer radial edge of paddle 230 and magnetic sensor 250A is positioned along the bottom of the outer surface of wall 205 and magnetic sensor 250B is positioned along the side of the outer surface of wall 205. Alternatively, magnetic sensor(s) 250A, 250B may be positioned in a portion of the image forming device adjacent to the outer surface of wall 205 when toner cartridge 200 is installed in the image forming device. PCB 201A may also be positioned on other portions of body 204 as desired.

The number of passes of paddle 230 past magnetic sensor 250A per each revolution of shaft 210 may be correlated to the amount of toner 203 in reservoir 202 when the toner level is low. In one embodiment, the number of passes of paddle 230 per revolution of shaft 210 is determined by counting the number of digital pulses from magnetic sensor 250A per revolution of shaft 210. The width of each digital pulse varies depending on the time duration of magnetic sensor 250A sensing magnet 240.

Figure 8:
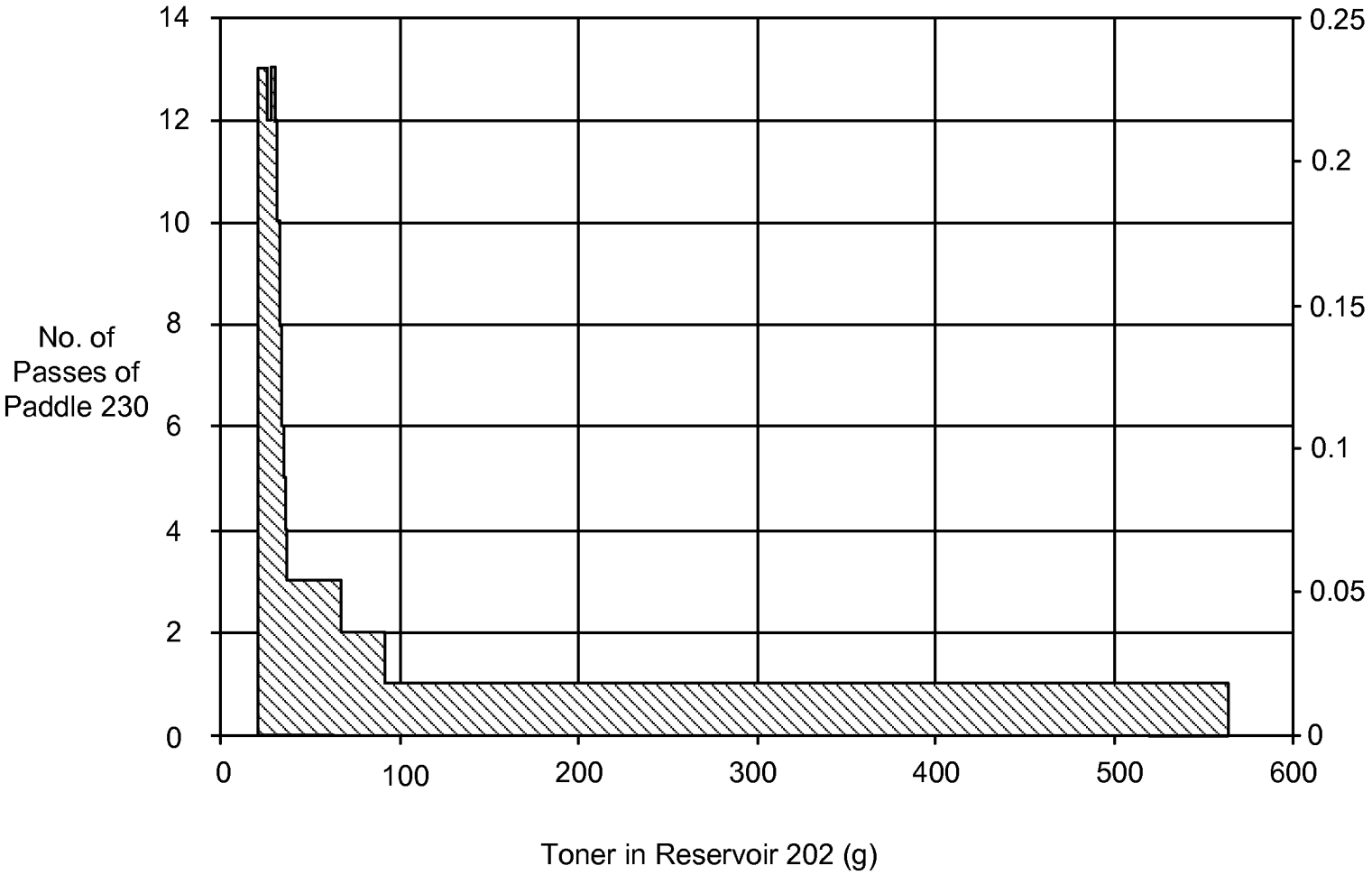
FIG. 8 is a graph of the number of passes of a falling paddle past a magnetic sensor per rotation of a shaft versus an amount of toner remaining in a reservoir (in grams) over the life of one example embodiment of a toner cartridge.

FIG. 8 shows a graph of the number of passes of paddle 230 past magnetic sensor 250A per revolution of shaft 210 versus the amount of toner 203 remaining in reservoir 202 (in grams) over the life of one example embodiment of toner cartridge 200. Before the toner level in reservoir 202 is low such as depicted in FIGS. 6A and 6B, paddle 230 passes magnetic sensor 250A once per revolution of shaft 210. Specifically, the resistance provided by toner 203 in reservoir 202 prevents paddle 230 from reaching magnetic sensor 250A ahead of driving member 217. Before the toner level in reservoir 202 is low, the width of a digital pulse from magnetic sensor 250A reflects the amount of time it takes for magnet 240 of paddle 230 to pass through a sensing window of magnetic sensor 250A (i.e., in sufficient proximity for magnetic sensor 250A to sense magnet 240). The amount of time it takes for magnet 240 of paddle 230 to pass through the sensing window of magnetic sensor 250A depends on the rotational speed of shaft 210 and driving member 217.

Once the toner level in reservoir 202 is low, however, as depicted in FIG. 6C, paddle 230 begins to oscillate or swing in a pendulum manner past magnetic sensor 250A more than once per revolution of shaft 210. As the toner level decreases, the number of passes of paddle 230 past magnetic sensor 250A per revolution of shaft 210 increases as a result of the decreased resistance from toner 203. Depending on the architecture of toner cartridge 200 and the rotational speed of shaft 210, magnetic sensor 250A may detect two passes of paddle 230 when the toner level in reservoir 202 is low enough for paddle 230 to fall forward ahead of driving member 217 and reach the sensing window of magnetic sensor 250A (1st pass) but rebound back out of the sensing window as a result of the resistance from toner 203 until driving member 217 pushes paddle 230 through the sensing window of magnetic sensor 250A (2nd pass). Otherwise, magnetic sensor 250A may detect two passes of paddle 230 when the toner level in reservoir 202 is low enough for paddle 230 to fall forward ahead of driving member 217 all the way through the sensing window of magnetic sensor 250A (1st pass) and then for paddle 230 to swing back into the sensing window of magnetic sensor 250A where paddle 230 comes to rest until driving member 217 pushes paddle 230 out of the sensing window of magnetic sensor 250A (2nd pass). Magnetic sensor 250A may detect three passes of paddle 230 when the toner level in reservoir 202 is low enough for paddle 230 to fall forward ahead of driving member 217 all the way through the sensing window of magnetic sensor 250A (1st pass), and then for paddle 230 to swing back all the way through the sensing window of magnetic sensor 250A again (2nd pass) and then back into the sensing window of magnetic sensor 250A where paddle 230 rests until driving member 217 pushes paddle 230 out of the sensing window of magnetic sensor 250A (3rd pass). Magnetic sensor 250A may detect four or more passes of paddle 230 in a similar manner as paddle 230 oscillates back and forth through the sensing window of magnetic sensor 250A until driving member 217 pushes paddle 230 through the sensing window of magnetic sensor 250A. The number of passes of paddle 230 past magnetic sensor 250A per revolution of shaft 210 may reach twelve or more when the toner level in reservoir 202 is very low depending on the speed of shaft 210 and the swing period of paddle 230.

Figure 9:
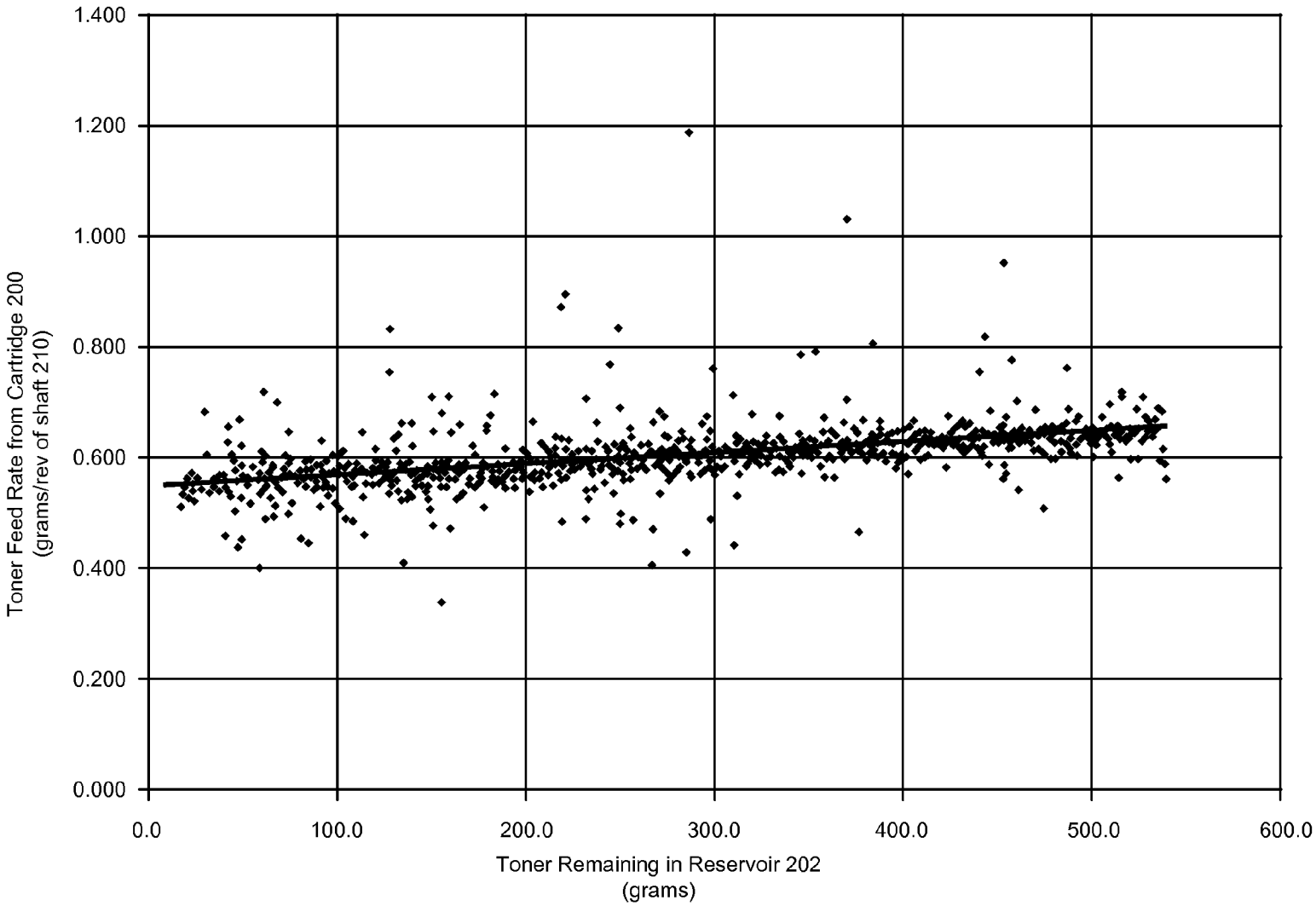
FIG. 9 is a plot of a feed rate of toner exiting a reservoir (in grams per revolution of a shaft in the reservoir) versus an amount of toner remaining in the reservoir (in grams) over the life of one example embodiment of a toner cartridge.

It will be appreciated from FIG. 8 that counting or monitoring the number of passes of paddle 230 past magnetic sensor 250A provides an indication of the amount of toner 203 remaining in reservoir 202 when the toner level is low (i.e., when paddle 230 passes magnetic sensor 250A more than once per revolution of shaft 210). Before the toner level is low (i.e., when paddle 230 passes magnetic sensor 250A once per revolution of shaft 210), the toner level in reservoir 202 can be approximated based on an empirically determined feed rate of toner 203 from toner reservoir 202 into the corresponding imaging unit. It has been observed that the feed rate of toner 203 from reservoir 202 decreases in a nearly linear fashion as the toner level in reservoir 202 decreases with normal variations due to such factors as the properties of toner 203, environmental conditions, and hardware tolerances. For example, FIG. 9 shows a plot of the feed rate of toner exiting reservoir 202 (in grams per revolution of shaft 210) versus the amount of toner remaining in reservoir 202 (in grams) over the life of one example embodiment of toner cartridge 200. The geometry and rotational speed of agitator(s) 216 and the rotatable auger (if present) determine how much toner 203 is fed per revolution of shaft 210. It will be appreciated by those skilled in the art that the use of a rotatable auger to exit toner 203 from reservoir 202 helps control the precision of the feed rate of toner 203 exiting toner cartridge 200. The linear decrease in the feed rate of toner 203 from reservoir 202 is due to the decrease in density of the toner 203 in reservoir 202 as the height of toner 203 decreases. As a result, the toner level in reservoir 202 can be approximated by starting with the initial amount of toner 203 supplied in reservoir 202 and reducing the amount of toner 203 in reservoir 202 per each rotation of shaft 210 based on the empirically determined feed rate. This estimation of the toner level in reservoir 202 may be used until magnetic sensor 250A detects paddle 230 passing more than once during a revolution of shaft 210. Once paddle 230 begins passing magnetic sensor 250A more than once per revolution of shaft 210, the number of pulses from magnetic sensor 250A per revolution of shaft 210 may be used in combination with the empirically determined feed rate to determine the amount of toner 203 remaining in reservoir 202 as discussed in greater detail below.

In one embodiment, shaft 210 is driven at a relatively low speed such as, for example, from about 3 RPM to about 45 RPM including all increments and values therebetween such as about 40 RPM or less in order to allow paddle 230 to oscillate past magnetic sensor 250A more than once per revolution of shaft 210 when reservoir 202 has little toner remaining before driving member 217 resumes pushing paddle 230. The slower shaft 210 rotates, the more paddle 230 may oscillate before driving member 217 catches up to paddle 230.

If shaft 210 rotates at a relatively high speed such as, for example, greater than about 45 RPM, paddle 230 may not have time to oscillate past magnetic sensor 250A before driving member 217 catches up or paddle 230 may not fall away from driving member 217. However, regardless of the speed of shaft 210, the number of passes of paddle 230 past magnetic sensor 250A may be measured when shaft 210 is stopped. As a result, in another embodiment, shaft 210 is rotated at a speed of at least about 40 RPM and stopped periodically in order to collect data from magnetic sensor 250A. It will be appreciated that in this embodiment if driving member 217 is positioned near the "6 o'clock" position when shaft 210 stops, driving member 217 may interfere with the oscillating motion of paddle 230 when the toner level in reservoir 202 is low. Accordingly, where shaft 210 is driven at a speed above about 40 RPM and stopped periodically to collect data from magnetic sensor 250A, it is preferred to avoid rotating shaft 210 a full 360 degree rotation or a multiple thereof each time shaft 210 rotates (i.e., 360 degrees, 720 degrees, 1080 degrees, etc.), otherwise driving member 217 may tend to be positioned near the "6 o'clock" position every time shaft 210 stops thereby interfering with the oscillating motion of paddle 230 when the toner level in reservoir 202 is low. Similarly, if shaft 210 is rotated in half rotation increments each time shaft 210 rotates (i.e., 180 degrees, 540 degrees, 900 degrees, etc.), driving member 217 may tend to be positioned near the "6 o'clock" position every other time shaft 210 stops. Accordingly, in one embodiment where shaft 210 is driven at a speed above about 40 RPM and stopped periodically to collect data from magnetic sensor 250A, shaft 210 is rotated at least about 10 degrees more or less than any full or half rotation (e.g., between about 190 degrees and about 350 degrees, between about 370 degrees and about 530 degrees, between about 550 degrees and about 710 degrees, between about 730 degrees and about 890 degrees, etc.) each time shaft 210 rotates in order to prevent driving member 217 from repeatedly stopping near the "6 o'clock" position and interfering with the oscillating motion of paddle 230 when the toner level in reservoir 202 is low. For example, in the example embodiment illustrated in FIG. 8, shaft 210 was rotated 550 degrees at 100 RPM and paused for about 3 seconds between each 550 degree rotation in order to allow paddle 230 to oscillate.

The point at which paddle 230 begins to pass magnetic sensor 250A more than once per revolution of shaft 210 (the sensing range of paddle 230) and the swing period of paddle 230 depend on the weight of paddle 230 and the radius of gyration of paddle 230 in addition to the rotational speed of shaft 210. As discussed above, paddle 230 may be weighted using one or more optional weights 231 in order to provide a desired weight distribution to define the weight and radius of gyration of paddle 230. Specifically, control of the sensing range by the weight of paddle 230 and the center of gravity of paddle 230 is governed by the initial energy state at the onset of the fall of paddle 230 for a given weight and radius of gyration of paddle 230. As paddle 230 encounters toner 203 in reservoir 202 with each oscillation, this energy is diminished by an amount that is a function of the mass of toner 203 encountered by paddle 230 during that oscillation. This decrease in energy occurs until paddle 230 stops swinging (either through encounters with toner 203 or through other frictions or resistance such as the energy lost in the frictional interface between paddle 230 and shaft 210). In addition to the sensing range, the number of oscillations of paddle 230 that occur when reservoir 202 is empty (the sensing resolution of paddle 230) also depends on the weight distribution of paddle 230.

Figure 10:
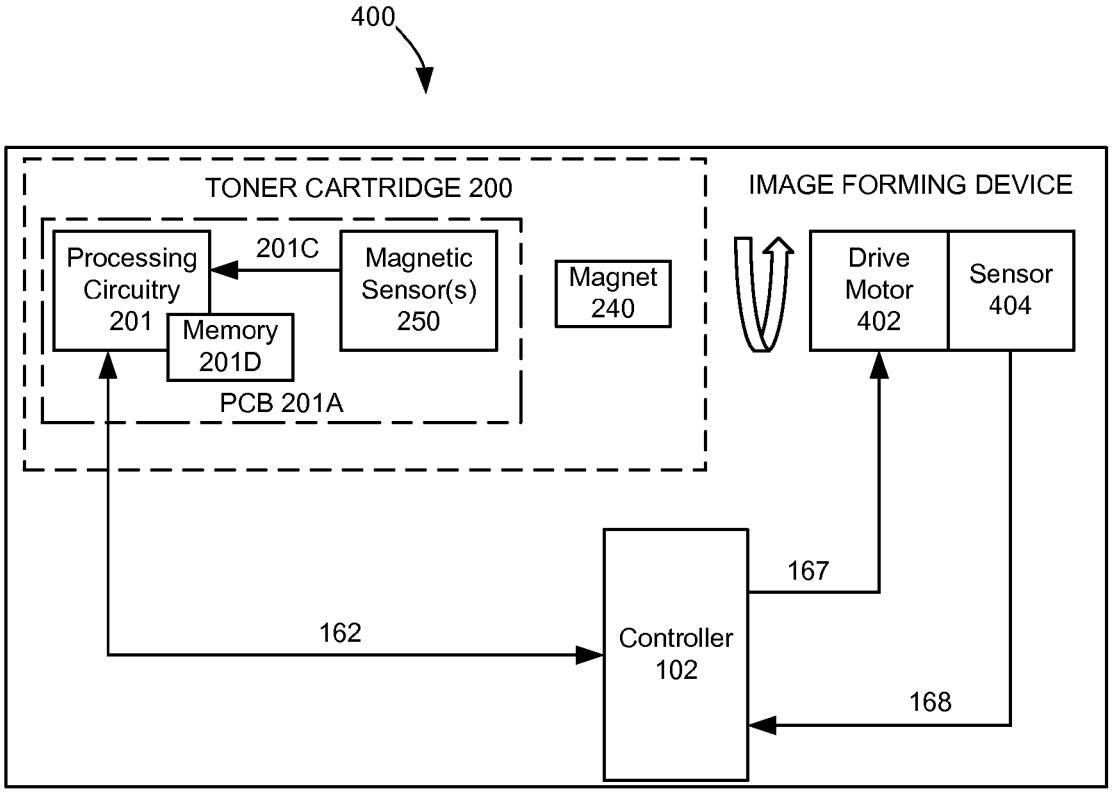
FIG. 10 is a block diagram depiction of a toner level sensing system according to one example embodiment.

FIG. 10 is a block diagram depiction of a toner level sensing system 400 using paddle 230 having magnet 240 and magnetic sensor(s) 250 according to one example embodiment. In this embodiment, magnetic sensor(s) 250 are positioned on body 204 of toner cartridge 200 in position to sense magnet 240 as paddle 230 rotates. Magnetic sensor(s) 250 communicate with processing circuitry 201 of toner cartridge 200 via a communications link 201C. As shown, processing circuitry 201 includes memory 201D. Processing circuitry 201 of toner cartridge 200 communicates with controller 102 via communications link 162. Controller 102 communicates with a drive motor 402 in image forming device 100, 100' via a communications link 167 to selectively power drive motor 402. Drive motor 402 provides rotational motion to drive element 214 when toner cartridge 200 is installed in the image forming device. Drive motor 402 includes an encoder device, such as a conventional encoder wheel mounted on the shaft of drive motor 402, and a corresponding sensor 404, such as a corresponding optical sensor, that detects the rotation of the shaft of drive motor 402. Sensor 404 communicates with controller 102 via a communications link 168 allowing controller 102 to monitor the rotation of drive motor 402.

Figure 11:
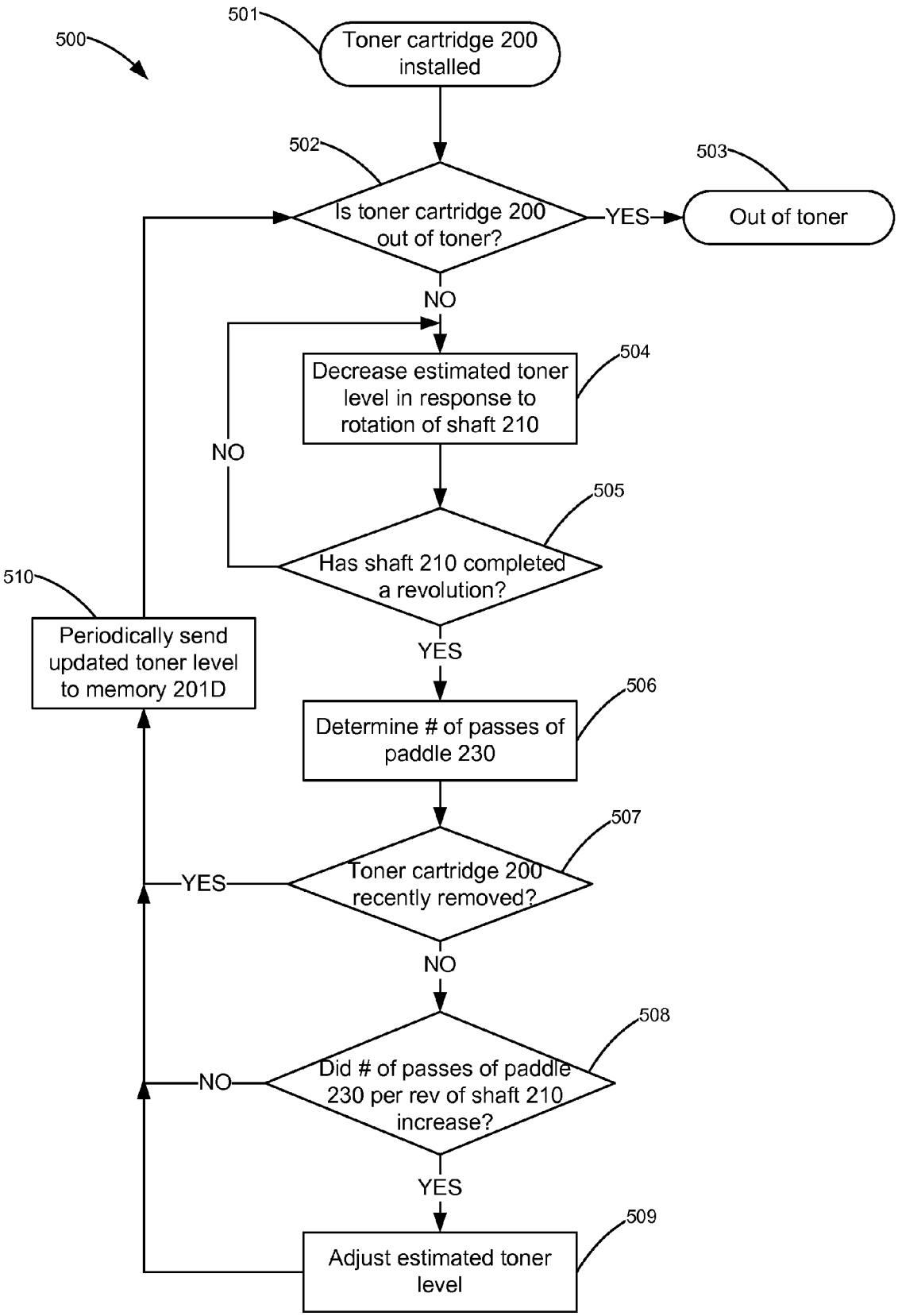
FIG. 11 is a flowchart showing a method for determining an amount of toner remaining in a reservoir of a replaceable unit of the image forming device according to one example embodiment.

FIG. 11 is a flowchart showing a method 500 for determining the amount of toner 203 remaining in reservoir 202 of toner cartridge 200 according to one example embodiment. At step 501, toner cartridge 200 is installed in the image forming device. Toner cartridge 200 may be installed at any point during the life of toner cartridge 200. Accordingly, toner cartridge 200 may be installed with reservoir 202 full of useable toner, out of useable toner or containing a fraction of its maximum amount of usable toner. At step 502, controller 102 (or another processing device in communication with controller 102 such as processing circuitry 201) makes an initial determination of whether reservoir 202 is out of useable toner 203. In one embodiment, memory 201D associated with processing circuitry 201 stores an estimate of the amount of toner 203 remaining in reservoir 202. In this embodiment, the processing device reads memory 201D to determine whether toner cartridge 200 is out of usable toner 203. In other embodiments, a toner sensor in the imaging unit corresponding with toner cartridge 200 may sense whether toner 203 is received by the imaging unit from reservoir 202 upon rotating drive motor 402 to drive shaft 210 with toner cartridge 200 installed. If toner 203 is not received by the imaging unit, the processing device determines that reservoir 202 is out of usable toner 203.

At step 503, in one embodiment, when the processing device determines that reservoir 202 is out of usable toner 203, a message indicating that reservoir 202 is out of usable toner 203 is displayed on user interface 104 and/or display monitor 36. In some embodiments, when the processing device determines that the reservoir 202 of a particular toner cartridge 200 is out of usable toner 203, the image forming device may shut down printing of the color of toner carried by that particular toner cartridge 200 (or printing of any color) until the empty toner cartridge 200 is replaced in order to prevent damage to downstream components in the imaging unit corresponding to the toner cartridge 200.

At step 504, if reservoir 202 contains usable toner 203, the processing device decreases the estimate of the amount of toner remaining in reservoir 202 in response to the rotation of shaft 210. The estimate of the amount of toner remaining in reservoir 202 may be expressed directly by an amount of toner, such as a mass of toner, or indirectly using a measure that corresponds with the amount of toner 203 remaining in reservoir 202 such as, for example, a number of revolutions of shaft 210, a number of revolutions of drive motor 402, a number of encoder windows sensed by sensor 404, a number of toner addition cycles, a number of pages printed, a number of pels printed, etc. In one embodiment, the estimate of the amount of toner 203 remaining is decreased according to the empirically determined feed rate of toner 203 from toner reservoir 202 into the corresponding imaging unit. The feed rate of toner 203 from reservoir 202 may be expressed, for example, in terms of the mass of toner fed per revolution of shaft 210, per revolution of drive motor 402, per toner addition cycle, etc.

At step 505, the processing device monitors whether shaft 210 has completed a revolution, which may be determined using a variety of methods. In one embodiment, a revolution of shaft 210 is determined using an encoder wheel and corresponding sensor 404 on drive motor 402. Specifically, the total number of encoder windows making up one revolution of the encoder wheel of drive motor 402 may be adjusted based on the gear ratio between drive motor 402 and shaft 210 in order to determine the number of encoder windows that make up one revolution of shaft 210. In another embodiment, a revolution of shaft 210 is determined using a flag on drive element 214 where shaft 210 has a 1:1 gear ratio with drive element 214 or on another gear or coupler on body 204 having a 1:1 gear ratio with shaft 210 that passes an optical sensor once per revolution of shaft 210. Similarly, where an encoder wheel and corresponding sensor 404 on drive motor 402 are used to detect a revolution of shaft 210, a flag on drive motor 402 that passes an optical sensor once per revolution of drive motor 402 may be used to confirm that the encoder wheel hasn't drifted backwards causing an encoder window to be counted more than once per revolution of drive motor 402. In another embodiment, magnetic sensor 250B is used to determine that shaft 210 has completed a revolution. Specifically, a revolution of shaft 210 is detected when the time between magnetic sensor 250A sensing magnet 240 and magnetic sensor 250B sensing magnet 240 (where magnetic sensor 250B is positioned less than 180 degrees ahead of magnetic sensor 250A in the direction of rotation of shaft 210) exceeds a predetermined threshold (e.g., half the rotational period of shaft 210) indicating that paddle 230 has traveled greater than 180 degrees from magnetic sensor 250A to magnetic sensor 250B as opposed to oscillating opposite the rotational direction of shaft 210 less than 180 degrees from magnetic sensor 250A to magnetic sensor 250B. In another embodiment, magnetic sensor 250A is used to determine that shaft 210 has completed a revolution. Specifically, a revolution of shaft 210 is detected when the time between two successive instances of magnetic sensor 250A sensing magnet 240 exceeds a predetermined threshold (e.g., half the rotational period of shaft 210) indicating that paddle 230 has traveled 360 degrees to return to magnetic sensor 250A as opposed to oscillating in a pendulum manner back and forth past magnetic sensor 250A during a single revolution of shaft 210. Those skilled in the art will appreciate that other suitable methods may be used to determine whether shaft 210 has completed a revolution.

At step 506, when shaft 210 completes a revolution, the processing device determines the number of passes of paddle 230 at the lowest center of gravity of paddle 230 based on the number of times magnetic sensor 250A detects the presence of magnet 240 during the revolution of shaft 210.

At step 507, the processing device may determine whether toner cartridge 200 was recently removed from the image forming device, which may be detected, for example, by a break in the contact between electrical contacts 201B and the corresponding electrical contacts in the image forming device or by using a conventional mechanical flag sensor or optical sensor that detects the presence or absence of toner cartridge 200 in the image forming device. When toner cartridge 200 is removed from the image forming device, toner 203 may shift to a portion of reservoir 202 away from paddle 230. As a result, when toner cartridge 200 is reinserted into the image forming device and shaft 210 is rotated, the uneven distribution of toner 203 in reservoir 202 and absence of toner 203 near paddle 230 may cause paddle 230 to oscillate more than it otherwise would given the amount of toner 203 still remaining in reservoir 202 if toner 203 was more evenly distributed in reservoir 202. As a result, it may be desirable to ignore the data from magnetic sensor 250A for a predetermined number of rotations of shaft 210 after toner cartridge 200 is reinserted into the image forming device in order to allow the toner 203 in reservoir 202 to distribute more evenly. Otherwise the extra oscillations of paddle 230 due to an uneven toner distribution may be misinterpreted as a lower toner level than actually exists in reservoir 202.

At step 508, if toner cartridge 200 has not been removed from the image forming device recently, the processing device determines whether the number of passes of paddle 230 per revolution of shaft 210 has increased. In one embodiment, this includes determining whether the number of passes of paddle 230 per revolution of shaft 210 has increased for, as examples, two out of the last three revolutions of shaft 210, three out of the last four revolutions of shaft 210, three out of the last five revolutions of shaft 210, etc. in order to account for normal variations which may cause paddle 230 to oscillate more or less than expected in any given rotation of shaft 210.

At step 509, where the number of passes of paddle 230 per revolution of shaft 210 has increased, the processing device adjusts the estimate of the amount of toner 203 remaining in reservoir 202 based on an empirically determined amount of toner 203 corresponding with the number of passes of paddle 230 detected per revolution of shaft 210. In one embodiment, when the number of passes of paddle 230 per revolution of shaft 210 increases, the processing device substitutes the empirically determined amount of toner 203 corresponding with the number of passes of paddle 230 detected per revolution of shaft 210 for the present estimate of the amount of toner 203 remaining. For example, where the number of passes of paddle 230 per revolution of shaft 210 increases from one to two, the processing device may substitute an empirically determined amount of toner 203 corresponding with two passes of paddle 230 per revolution of shaft 210 for the present estimate of the amount of toner 203 remaining. The processing device then decreases the revised estimate of the amount of toner 203 remaining as discussed above in step 504 until the number of passes of paddle 230 per revolution of shaft 210 increases from two to three at which point the processing device once again adjusts the estimate of the amount of toner 203 remaining. In another embodiment, when the number of passes of paddle 230 per revolution of shaft 210 increases, the processing device recalculates the estimate of the amount of toner 203 remaining by weighting both the empirically determined amount of toner 203 corresponding with the number of passes of paddle 230 detected per revolution of shaft 210 and the present estimate of the amount of toner 203 remaining. For example, where the number of passes of paddle 230 per revolution of shaft 210 increases from one to two, the processing device may give fifty percent weight (or any other suitable weight) to an empirically determined amount of toner 203 corresponding with two passes of paddle 230 per revolution of shaft 210 and fifty percent weight (or any other suitable weight) to the present estimate of the amount of toner 203 remaining to determine the new estimate of the amount of toner 203 remaining in reservoir 202. The processing device then decreases the revised estimate of the amount of toner 203 remaining as discussed above in step 504 until the number of passes of paddle 230 per revolution of shaft 210 increases from two to three at which point the processing device once again calculates a new estimate of the amount of toner 203 remaining.

At step 510, the processing device periodically sends the current estimate of the amount of toner 203 remaining in reservoir 202 to processing circuitry 201 for storage in memory 201D associated with processing circuitry 201. In this manner, the estimate of the amount of toner 203 remaining in reservoir 202 travels with toner cartridge 200 if toner cartridge 200 is removed and inserted into a different image forming device so that the new image forming device will be able to continue to estimate the amount of toner 203 remaining in reservoir 202 accurately. Further, memory 201D associated with processing circuitry 201 also serves a storage backup for the estimate of the amount of toner 203 remaining in case the power to the image forming device that toner cartridge 200 is installed in is interrupted.

Back at step 502, the processing device determines whether reservoir 202 is out of useable toner 203 based on the most recent estimate of toner 203 remaining as determined at step 504 and adjusted periodically at step 509.

Figure 12:
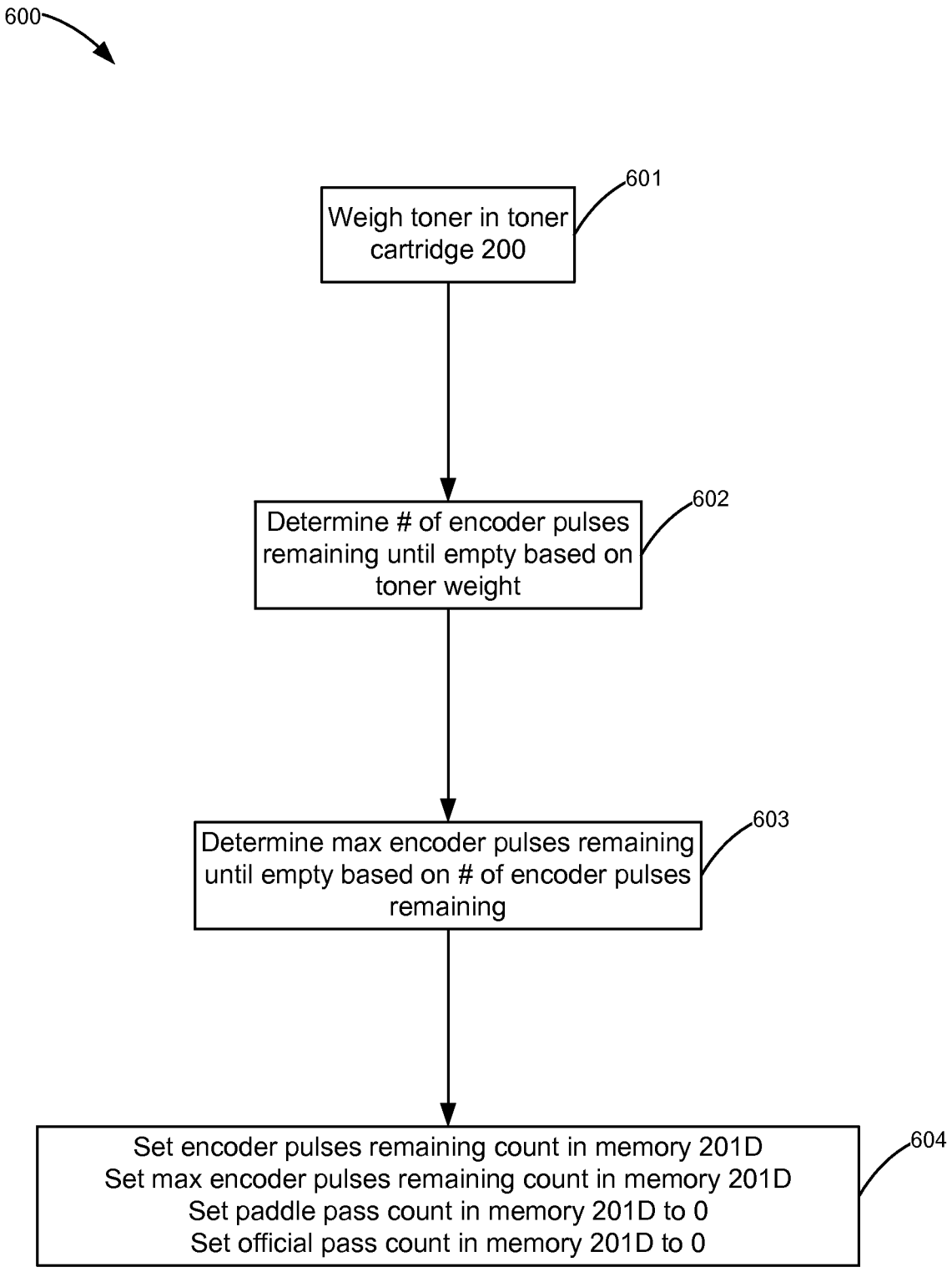
FIG. 12 is a flowchart showing a method for programming memory of a newly filled toner cartridge according to one example embodiment.

FIGS. 12-14B are a series of flowcharts showing a method for determining the amount of toner 203 remaining in reservoir 202 of toner cartridge 200 and the communication between processing circuitry 201 of toner cartridge 200 and controller 102 of the image forming device according to one example embodiment. FIG. 12 is a flowchart showing a method 600 for programming the memory 201D of a newly filled toner cartridge 200 according to one example embodiment. At step 601, the toner 203 in reservoir 202 of toner cartridge 200 is weighed. To determine the weight of the toner 203 in reservoir 202, the toner 203 may be weighed prior to placement in reservoir 202 or the weight of toner cartridge 200 before and after toner 203 is added to reservoir 202 may be compared. The amount of toner 203 weighed may be converted to an amount of usable toner 203 in order to account for a percentage of toner 203 that will be unusable due to inefficiencies in the removal of toner 203 from toner cartridge 200.

At step 602, the weight of the toner 203 determined at step 601 is converted to an approximate number of total encoder windows that will need to be sensed by sensor 404 during rotation of drive motor 402 in order to empty reservoir 202, referred to as the number of encoder pulses remaining. As discussed above, the toner level in reservoir 202 can be approximated based on an empirically determined feed rate of toner 203 from toner reservoir 202 into the corresponding imaging unit. With reference back to FIG. 9, the decrease in the feed rate of toner 203 from reservoir 202 may be expressed using linear Equation 1 where: TFR=toner feed rate, s=slope of the toner feed rate line, m=toner mass and b=y-intercept of the toner feed rate line.

$$\mathrm{TFR}=s*m+b \tag{1}$$

The number of revolutions of shaft 210 required to empty toner reservoir 202 may be determined by integrating the reciprocal of linear Equation 1 with respect to mass according to Equation 2 where: r(m)=number of revolutions of shaft 210, M=toner fill weight and MR=residual toner weight when all usable toner 203 is removed from reservoir 202.

$$r(m)=\int_{MR}^{M}\frac{1}{s*m+b}dm \tag{2}$$

Accordingly, at toner fill weight M with residual toner MR, the number of revolutions of shaft 210 remaining until reservoir 202 is empty is expressed by Equation 3.

$$r(m)=\left(\frac{1}{s}\right)*\left[\ln\left(\frac{s*M+b}{b}\right)-\ln\left(\frac{s*MR+b}{b}\right)\right] \tag{3}$$

The number of revolutions of shaft 210 may be converted to the number of encoder pulses remaining until reservoir 202 is out of usable toner using Equation 4 where: ER=the number of encoder pulses remaining, w=the number of windows on the encoder wheel of drive motor 402 and GR=the gear ratio between drive motor 402 and shaft 210.

$$\mathrm{ER}=w*\mathrm{GR}*r(m) \tag{4}$$

Substituting Equation 3 into Equation 4 provides the following Equation 5 which may be used to determine the number of encoder pulses remaining for any given toner fill level and residual toner amount. Accordingly, Equation 5 may be used at step 602 to determine the number of encoder pulses remaining for a newly filled toner cartridge 200. As discussed in greater detail below, the number of encoder pulses remaining is adjusted periodically based on the number of passes of paddle 230 sensed by magnetic sensor 250A per revolution of shaft 210.

$$ER=\left(\frac{w*GR}{s}\right)*\left[\ln\left(\frac{s*M+b}{b}\right)-\ln\left(\frac{s*MR+b}{b}\right)\right] \tag{5}$$

At step 603, a maximum number of encoder pulses remaining until reservoir 202 is out of usable toner that is not readjusted during the life of toner cartridge 200 may be determined. The maximum number of encoder pulses remaining is useful in case magnetic sensor 250A, paddle 230 or magnet 240 is damaged or interfered with. In one embodiment, the maximum number of encoder pulses remaining is equal to the number of encoder pulses remaining determined at step 602 multiplied by a constant such as, for example, 105%, 110%, 120%, etc.

At step 604, the number of encoder pulses remaining until empty determined at step 602 and the number of maximum encoder pulses remaining until empty determined at step 603 are stored in memory 201D of processing circuitry 201 of toner cartridge 200. Two other variables that will be discussed in greater detail below, the pass count of paddle 230 and an official pass count, are set at zero in memory 201D.

While example method 600 and corresponding example methods 700 and 800 express the amount of toner 203 remaining in reservoir 202 using the number of encoder pulses from sensor 404 remaining until empty, as discussed above, the estimate of the amount of toner remaining in reservoir may be expressed directly by an amount of toner, such as a mass of toner, or indirectly using another measure that corresponds with the amount of toner 203 remaining in reservoir 202.

Figure 13:
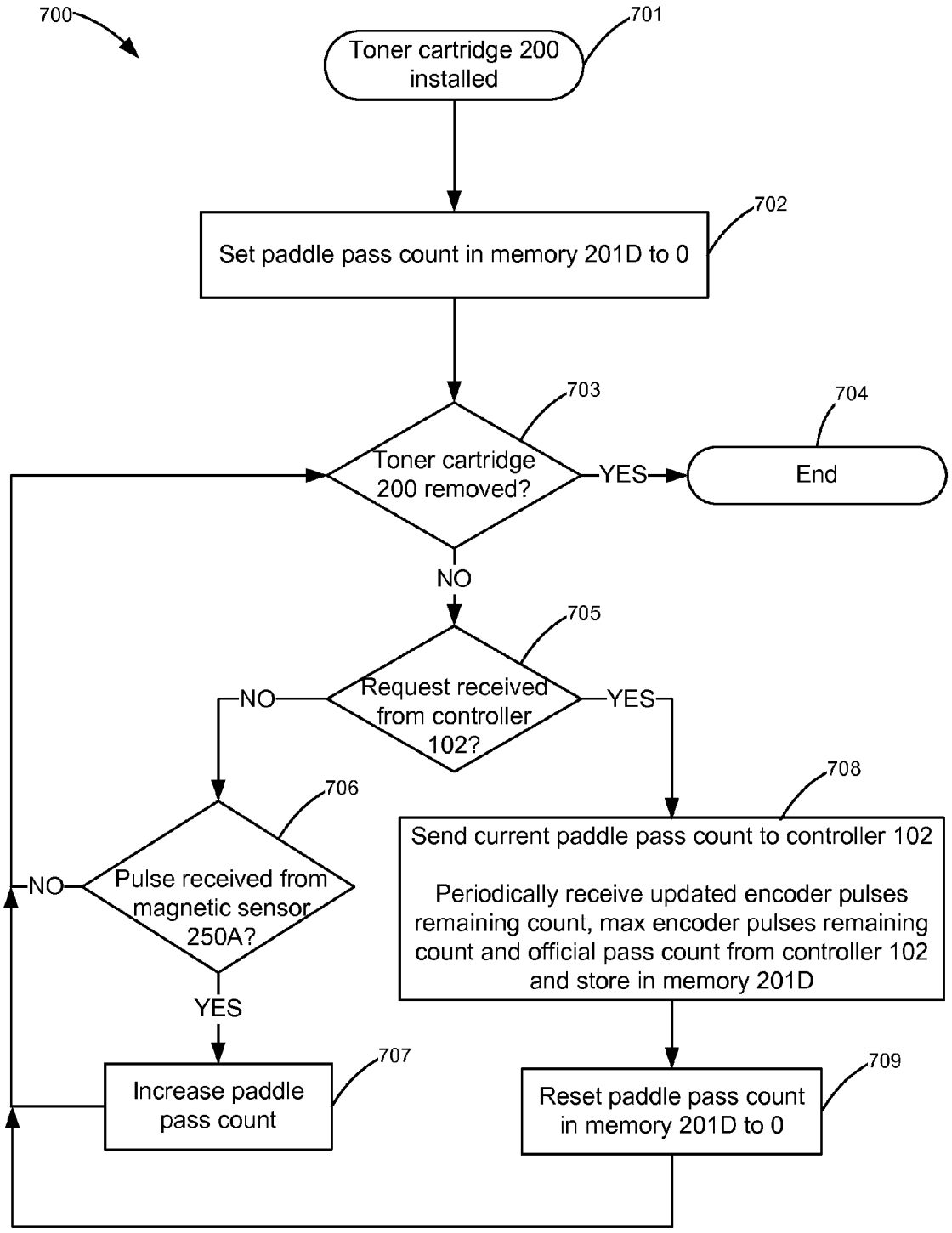
FIG. 13 is a flowchart showing a method for operating processing circuitry of a toner cartridge and communicating with a controller of the image forming device to determine an amount of toner remaining in the toner cartridge according to one example embodiment.

FIG. 13 is a flowchart showing a method 700 for operating processing circuitry 201 of toner cartridge 200 and communicating with controller 102 to determine the amount of toner 203 remaining in reservoir 202 of toner cartridge 200 according to one example embodiment. At step 701, toner cartridge 200 is installed in the image forming device. Toner cartridge 200 may be installed at any point during the life of toner cartridge 200. Accordingly, toner cartridge 200 may be installed with reservoir 202 full of useable toner, out of useable toner or containing a fraction of its maximum amount of usable toner. At step 702, processing circuitry 201 sets the pass count of paddle 230 in memory 201D to zero if it is not already set at zero.

At step 703, processing circuitry 201 monitors whether toner cartridge 200 has been removed from the image forming device which may be detected, for example, by a break in the contact between electrical contacts 201B and the corresponding electrical contacts in the image forming device. Method 700 ends at step 704 when toner cartridge 200 is removed.

At step 705, processing circuitry 201 monitors whether a request is received from controller 102 to report the pass count of paddle 230 to controller 102. At step 706, processing circuitry 201 periodically receives pulses from magnetic sensor 250A indicating that magnetic sensor 250A has detected magnet 240 of paddle 230. As discussed above, magnetic sensor 250A senses the presence of magnet 240 of paddle 230 during rotation of shaft 210. The number of times magnetic sensor 250A senses the presence of magnet 240 of paddle 230 during a single rotation of shaft 210 depends on the amount of toner 203 in reservoir 202. In one embodiment, processing circuitry 201 receives a digital pulse from magnetic sensor 250A each time magnetic sensor 250A senses magnet 240. As discussed above, the width of each digital pulse varies depending on the time duration of magnetic sensor 250A sensing magnet 240. Each time processing circuitry 201 receives a pulse from magnetic sensor 250A, processing circuitry 201 increases the pass count of paddle 230 in memory 201D by one at step 707. In one embodiment, when processing circuitry 201 receives a pulse from magnetic sensor 250A, processing circuitry 201 also records a time stamp of the pulse in memory 201D at step 707. In one embodiment, a rising edge of a digital pulse is used to create the time stamp; however, a falling edge of the digital pulse may be used instead as desired. In another embodiment, both the rising and falling edge of each digital pulse is recorded.

When a request is received by processing circuitry 201 from controller 102 at step 705, processing circuitry 201 sends the pass count of paddle 230 stored in memory 201D to controller 102 at step 708. Where time stamp data is also stored in memory 201D, processing circuitry 201 may send the time stamp data to controller 102 at step 708 as well. Processing circuitry 201 may also periodically receive and store information from controller 102 in memory 201D. For example, in the example embodiment illustrated, processing circuitry 201 periodically receives the current encoder pulses remaining count, maximum encoder pulses remaining count and official pass count from controller 102 for storage in memory 201D. As discussed above, these variables may then travel with toner cartridge 200 if toner cartridge 200 is removed and inserted into a different image forming device. At step 709, after processing circuitry 201 sends the pass count of paddle 230 to controller 102, processing circuitry 201 resets the pass count of paddle 230 in memory 201D to zero. In this manner, if controller 102 requests the pass count of paddle 230 from processing circuitry 201 once per revolution of shaft 210, the pass count of paddle 230 stored in memory 201D and sent to controller 102 will be the number of passes of paddle 230 for a single revolution of shaft 210. At step 709, processing circuitry 201 may also reset the time stamp data stored in memory 201D such that the first pulse received from magnetic sensor 250A after sending the pass count of paddle 230 to controller 102 at step 708 is assigned time zero and subsequent pulses received by processing circuitry 201 from magnetic sensor 250A before the next request from controller 102 at step 705 are assigned a time measured relative to time zero.

Figure 14A:
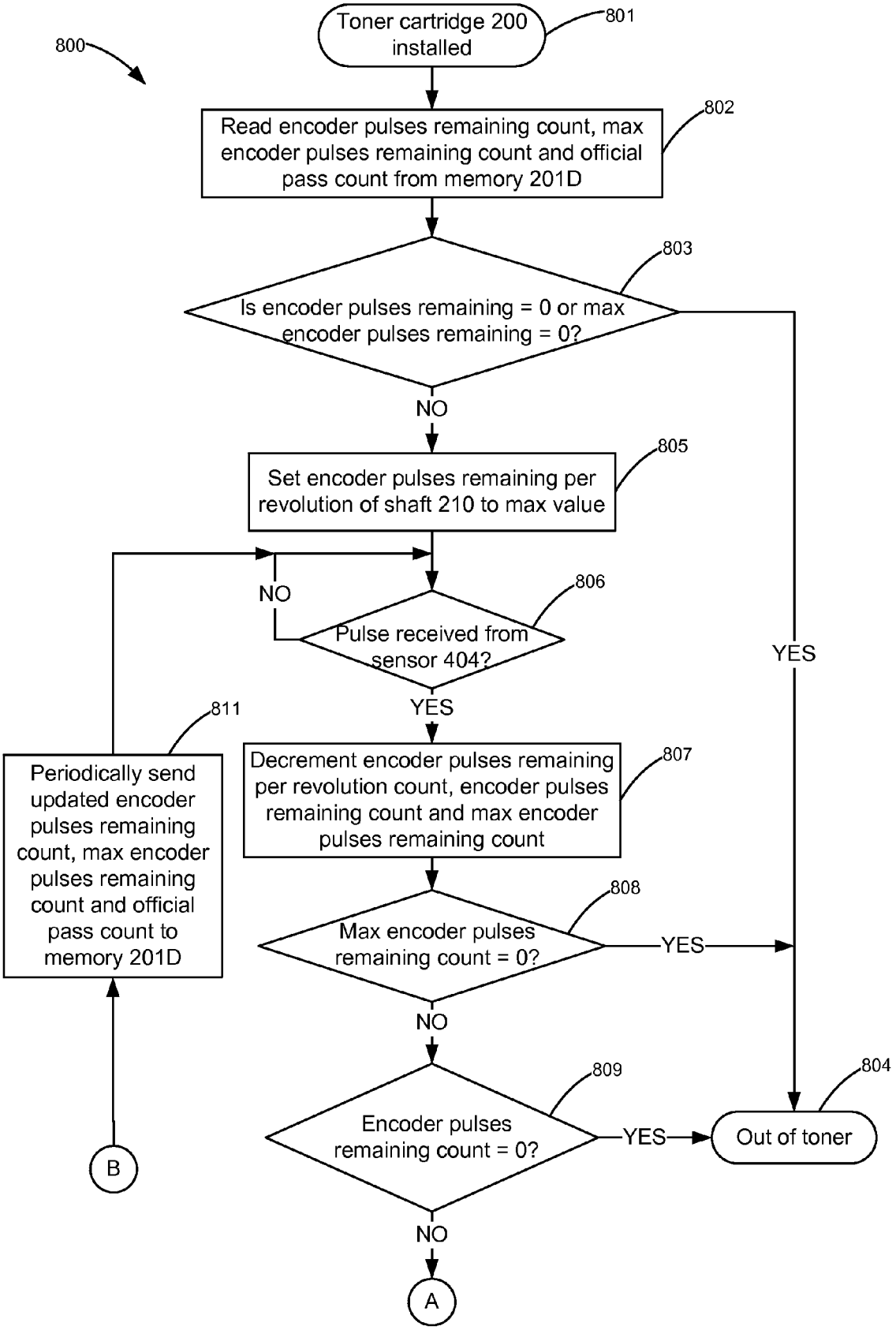
FIGS. 14A and 14B are a flowchart showing a method for operating the controller of the image forming device and communicating with processing circuitry of the toner cartridge to determine an amount of toner remaining in the toner cartridge according to one example embodiment.
Figure 14B:
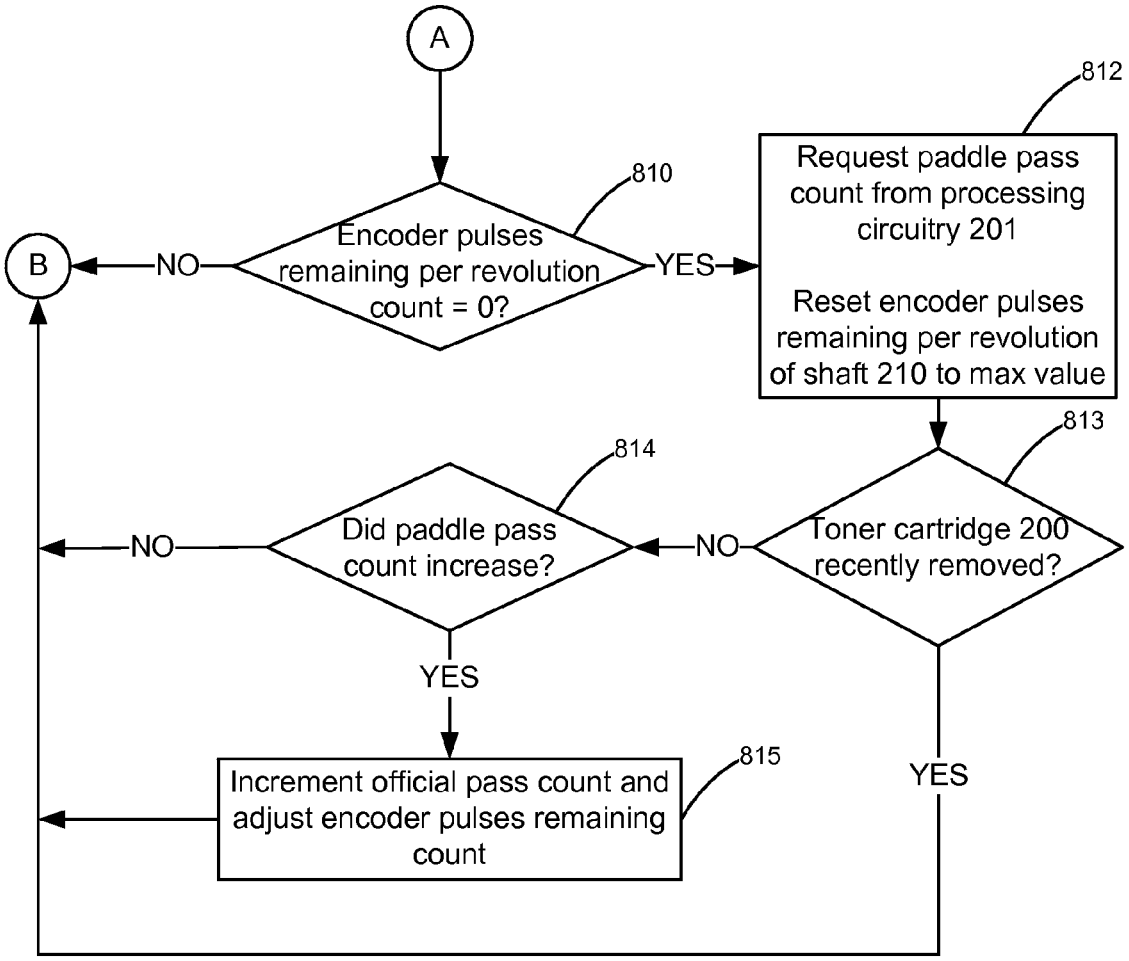

FIGS. 14A and 14B are a flowchart showing a method 800 for operating controller 102 of the image forming device and communicating with processing circuitry 201 of toner cartridge 200 to determine the amount of toner 203 remaining in reservoir 202 of toner cartridge 200 according to one example embodiment. At step 801, toner cartridge 200 is installed in the image forming device. As discussed above, toner cartridge 200 may be installed at any point during its useful life. At step 802, controller 102 reads the variables stored in memory 201D that indicate whether reservoir 202 is out of useable toner 203. For example, in the example embodiment illustrated, controller 102 reads the encoder pulses remaining until reservoir 202 is empty count, the maximum encoder pulses remaining count and the official pass count from memory 201D. At step 803, controller 102 determines whether toner cartridge 200 is out of usable toner 203 by determining whether the encoder pulses remaining until reservoir 202 is empty or the maximum encoder pulses remaining until reservoir 202 is empty is equal to zero.

At step 804, in one embodiment, when controller 102 determines that toner cartridge 200 is out of usable toner 203, controller 102 displays a message indicating that reservoir 202 is out of usable toner 203 on user interface 104 and/or display monitor 36. In some embodiments, when controller 102 determines that a particular toner cartridge 200 is out of usable toner 203, controller 102 shuts down printing of the color of toner carried by that particular toner cartridge 200 (or printing of any color) until the empty toner cartridge 200 is replaced in order to prevent damage to downstream components in the imaging unit corresponding to the toner cartridge 200.

At step 805, controller 102 sets a variable that measures the number of encoder pulses of drive motor 402 remaining per revolution of shaft 210 to the total number of encoder pulses of drive motor 402 for a single revolution of shaft 210. The total number of encoder pulses of drive motor 402 for a single revolution of shaft 210 may be determined using Equation 4 above where $r(m)=1$. The measure of the number of encoder pulses of drive motor 402 remaining per revolution of shaft 210 is used to detect each revolution of shaft 210 to determine when shaft 210 has completed a revolution. However, as discussed above at step 505 of method 500, a variety of other methods may be used as desired to determine when shaft 210 has completed a revolution.

At step 806, controller 102 monitors whether a pulse is received from sensor 404 associated with the encoder wheel of drive motor 402 indicating that one of the windows of the encoder wheel of drive motor 402 has passed. Each time a pulse is received from sensor 404, controller 102 decrements the encoder pulses remaining until reservoir 202 is empty count, the maximum encoder pulses remaining until empty count and the encoder pulses remaining per revolution of shaft 210 count at step 807.

At step 808, controller 102 may monitor whether the maximum encoder pulses remaining until empty count has reached zero. As discussed above, the maximum number of encoder pulses remaining count is not readjusted during the life of toner cartridge 200 and provides a hard stop for toner cartridge 200 in the event that magnetic sensor 250A, paddle 230 or magnet 240 is damaged or interfered with. If the maximum encoder pulses remaining count reaches zero, controller 102 concludes that toner cartridge 200 is out of usable toner 203 and proceeds to step 804 discussed above.

At step 809, controller 102 monitors whether the encoder pulses remaining until reservoir 202 is empty count has reached zero. In one embodiment, if the encoder pulses remaining until reservoir 202 is empty count reaches zero, controller 102 concludes that toner cartridge 200 is out of usable toner and proceeds to step 804 discussed above.

At step 810, controller 102 monitors whether a revolution of shaft 210 is complete by monitoring whether the encoder pulses remaining per revolution of shaft 210 has reached zero. If the encoder pulses remaining per revolution of shaft 210 is greater than zero indicating that shaft 210 has not completed a revolution, controller 102 continues to monitor and track the pulses received from sensor 404 at steps 806-809. As shown at step 811, controller 102 periodically sends the current encoder pulses remaining until empty count, the current maximum encoder pulses remaining count and the current official pass count to processing circuitry 201 for storage in memory 201D. As discussed above, these variables may then travel with toner cartridge 200 if toner cartridge 200 is removed and inserted into a different image forming device so that the new image forming device will be able to continue to estimate the amount of toner 203 remaining in reservoir 202 accurately.

At step 812, once controller 102 determines that shaft 210 has completed a revolution, controller 102 requests the pass count of paddle 230 from processing circuitry 201 of toner cartridge 200. By requesting the pass count of paddle 230 after every revolution of shaft 210, each pass count value received by controller 102 from processing circuitry 201 at step 812 represents the number of passes of paddle 230 past magnetic sensor 250A for one revolution. At step 812, controller 102 also resets the encoder pulses remaining per revolution of shaft 210 count to the total number of encoder pulses of drive motor 402 for a single revolution of shaft 210 as discussed above in step 805 so that controller 102 can then monitor whether shaft 210 has completed the next revolution.

At step 813, controller 102 may determine whether toner cartridge 200 was recently removed from the image forming device. In one embodiment, controller 102 determines whether toner cartridge 100 was removed from the image forming device within a predetermined number of the recent revolutions of shaft 210. For example, controller 102 may determine whether toner cartridge 100 was removed from the image forming device within the most recent five, ten, twenty, etc. revolutions of shaft 210. The number of recent revolutions used as a threshold at step 813 is preferably enough to ensure that if toner 203 in reservoir 202 was distributed unevenly as a result of the removal of toner cartridge 200 from the image forming device, shaft 210 has rotated enough to redistribute toner 203 more evenly in reservoir 202. As discussed above, when toner cartridge 200 is removed from the image forming device, toner 203 may shift within reservoir 202 causing an uneven distribution of toner 203 in reservoir 202 which may cause paddle 230 to oscillate more than it otherwise would given the amount of toner 203 still remaining in reservoir 202 if toner 203 was more evenly distributed in reservoir 202. Accordingly, in the example embodiment illustrated, if toner cartridge 200 was recently removed from the image forming device, controller 102 may ignore the pass count of paddle 230 received from processing circuitry 201 and return to monitoring and tracking the pulses received from sensor 404 at steps 806-809.

At step 814, if toner cartridge 200 has not been removed from the image forming device recently, controller 102 determines whether the number of passes of paddle 230 per revolution of shaft 210 has increased. As discussed above, in one embodiment, this includes determining whether the number of passes of paddle 230 per revolution of shaft 210 has increased for, as examples, two out of the last three revolutions of shaft 210, three out of the last four revolutions of shaft 210, three out of the last five revolutions of shaft 210, etc. in order to account for normal variations which may cause paddle 230 to oscillate more or less than expected in any given rotation of shaft 210.

If the condition monitored at step 814 is not satisfied, controller 102 returns to monitoring and tracking the pulses received from sensor 404 at steps 806-809. If, on the other hand, the number of passes of paddle 230 per revolution of shaft 210 has increased and satisfied the condition monitored at step 814, controller 102 increments the official pass count and adjusts the encoder pulses remaining until reservoir 202 is empty count. The official pass count is a filtered representation of the raw paddle 230 pass counts received by processing circuitry 201 from magnetic sensor 250A. The official pass count variable smooths out the raw data from magnetic sensor 250A to account for normal variations which may cause paddle 230 to oscillate more or less than expected in any given rotation of shaft 210. In one embodiment, the official pass count is by rule only incremented by one at step 815 each time the paddle pass count increases at step 814 regardless of the magnitude of the increase at step 814. Again, this rule helps account for normal variations which may cause paddle 230 to oscillate more or less than expected in any given rotation of shaft 210. Further, in one embodiment, at step 809, in addition to determining whether the encoder pulses remaining until reservoir 202 is empty count has reached zero, controller 102 also monitors whether the official pass count has exceeded a predetermined threshold. In this embodiment, reservoir 202 is deemed out of usable toner when both the encoder pulses remaining until reservoir 202 is empty count reaches zero and the official pass count exceeds the predetermined threshold. The predetermined threshold for the official pass count may be determined empirically for a given architecture of toner cartridge 200 at a point where the number of passes of paddle 230 reliably indicates that reservoir 202 is out of usable toner 203.

At step 815, controller 102 adjusts the encoder pulses remaining until empty count based on the official pass count. In one embodiment, when the official pass count increases, controller substitutes an empirically determined encoder pulses remaining until empty count corresponding with the current official pass count. For example, where the official pass count increases from one to two, controller 102 may substitute an empirically determined encoder pulses remaining until empty count for the current encoder pulses remaining until empty count. Controller 102 then decrements from the adjusted encoder pulses remaining until empty count as discussed above in step 807 until the official pass count increases from two to three at which point controller 102 will once again adjust the encoder pulses remaining until empty count. In another embodiment, when the official pass count increases, controller 102 recalculates the encoder pulses remaining until empty by weighting both the empirically determined encoder pulses remaining until empty count corresponding with the current official pass count and the current encoder pulses remaining until empty count. For example, where the official pass count increases from one to two, controller 102 may give fifty percent weight (or any other suitable weight) to an empirically determined encoder pulses remaining until empty count corresponding with an official pass count of two and fifty percent weight (or any other suitable weight) to the current encoder pulses remaining until empty count to determine the new encoder pulses remaining until empty count. Controller 102 then decreases the adjusted encoder pulses remaining until empty count as discussed above in step 807 until the official pass count increases from two to three at which point controller 102 once again calculates a new encoder pulses remaining until empty count. The weighting applied in this method to the empirically determined encoder pulses remaining until empty count corresponding with the official pass count may be the same for each official pass count value or the weighting applied may vary depending on the official pass count. For example, in one embodiment, the weight applied to the empirically determined encoder pulses remaining until empty count corresponding with the official pass count may increase as the official pass count approaches the official pass count threshold used in step 809. After the encoder pulses remaining until empty count is adjusted at step 815, controller 102 resumes monitoring and tracking the pulses received from sensor 404 at steps 806-809.

As discussed above, instead of estimating the amount of toner 203 remaining in reservoir 202 using the number of encoder pulses remaining until empty, the estimate of the amount of toner remaining in reservoir may be expressed directly by an amount of toner, such as a mass of toner, or indirectly using another measure that corresponds with the amount of toner 203 remaining in reservoir 202.

In one embodiment, controller 102 uses data from magnetic sensor 250B to adjust the encoder pulses remaining until empty count before the official pass count increases from one to two. In this embodiment, processing circuitry 201 stores time stamp data received from magnetic sensor 250B in memory 201D and, at step 812, controller 102 requests the time stamp data related to magnetic sensor 250B from processing circuitry 201. In this embodiment, in addition to determining whether the number of passes of paddle 230 per revolution of shaft 210 has increased, controller 102 also determines whether the width of a digital pulse from magnetic sensor 250B has fallen below a predetermined threshold. In one embodiment, this includes determining whether the width of the digital pulse from magnetic sensor 250B has fallen below the predetermined threshold for, as examples, two out of the last three passes of magnet 240 past magnetic sensor 250B, three out of the last four passes of magnet 240 past magnetic sensor 250B, four out of the last five passes of magnet 240 past magnetic sensor 250B, etc. in order to account for normal variations which may cause paddle 230 to pass magnetic sensor 250B faster or slower than expected in any given rotation of shaft 210.

With reference to FIG. 6A, when reservoir 202 is relatively full of toner 203, paddle 230 moves at the same speed as driving member 217 due to the resistance provided by toner 203. As a result, when reservoir 202 is relatively full of toner 203, the width of the digital pulse from magnetic sensor 250B during each revolution of shaft 210 reflects the rotational speed of shaft 210 and driving member 217. With reference to FIG. 6B, as the toner level in reservoir 202 decreases, the toner level reaches a point where paddle 230 falls forward ahead of driving member 217 after paddle 230 passes the "12 o'clock" position and rests on toner 203 in sufficient proximity for magnetic sensor 250B to sense magnet 240 (i.e., within the sensing window of magnetic sensor 250B). At this point, the width of the digital pulse from magnetic sensor 250B increases in comparison with a relatively full reservoir 202 reflecting the amount of time that paddle 230 rests on toner 203 in reservoir 202 until driving member 217 catches up with paddle 230 and resumes pushing paddle 230. As the toner level continues to decrease, the toner level reaches a point where paddle 230 falls forward ahead of driving member 217 and passes the sensing window of magnetic sensor 250B before resting on toner 203 past the range where magnetic sensor 250B can sense magnet 240. At this point, the width of the digital pulse from magnetic sensor 250B decreases significantly, reflecting the rotational speed of paddle 230 as paddle 230 falls ahead of driving member 217 and indicating that the time duration of magnetic sensor 250B sensing the magnetic field of magnet 240 has decreased significantly.

The amount of toner 203 in reservoir 202 when the digital pulse from magnetic sensor 250B decreases indicating that paddle 230 has fallen ahead of driving member 217 and past magnetic sensor 250B may be determined empirically for a given architecture of toner cartridge 200. This toner level may be converted to an amount of encoder pulses remaining until reservoir 202 is empty using Equation 5 above. In one embodiment, at step 815, controller 102 adjusts the encoder pulses remaining until empty count when the digital pulse from magnetic sensor 250B falls below the predetermined threshold based on the empirically determined toner level. As discussed above, controller 102 may substitute the empirically determined encoder pulses remaining until empty count for the current encoder pulses remaining until empty count or controller 102 may recalculate the encoder pulses remaining until empty by weighting both the empirically determined encoder pulses remaining until empty count corresponding to the decrease of the width of the digital pulse from magnetic sensor 250B and the current encoder pulses remaining until empty count. After the encoder pulses remaining until empty count is adjusted at step 815, controller 102 resumes monitoring and tracking the pulses received from sensor 404 at steps 806-809.

As desired, some or all of the steps of method 800 may be shifted from controller 102 to processing circuitry 201 or another processing device in communication with controller 102. Similarly, some or all of the steps of method 700 may be shifted from processing circuitry 201 to controller 102 or another processing device in communication with controller 102.

Accordingly, an amount of toner remaining in a reservoir may be determined by sensing the rotational motion of a falling paddle, such as paddle 230, mounted on a rotatable shaft and rotatable independent of the shaft within the reservoir. Because the motion of paddle 230 is detectable by a sensor outside of reservoir 202, paddle 230 may be provided without an electrical or mechanical connection to the outside of body 204 (other than shaft 210). This avoids the need to seal an additional connection into reservoir 202, which could be susceptible to leakage. Because no sealing of paddle 230 is required, no sealing friction exists that could alter the motion of paddle 230. Further, positioning the magnetic sensor(s) outside of reservoir 202 reduces the risk of toner contamination, which could damage the sensor(s). The magnetic sensor(s) may also be used to detect the installation of toner cartridge 200 in the image forming device and to confirm that shaft 210 is rotating properly thereby eliminating the need for additional sensors to perform these functions.

While the example embodiments illustrated show magnet 240 positioned on the body of paddle 230 in line with front face 230B of paddle 230 and the center of gravity of paddle 230, it will be appreciated that magnet 240 may be offset angularly from paddle 230 as desired. For example, magnet 240 may be positioned on an arm or other form of extension that is angled with respect to paddle 230 and connected to paddle 230 to rotate with paddle 230. For example, where two magnetic sensors 250A, 250B are used, if magnet 240 is offset 90 degrees ahead of paddle 230, magnetic sensor 250A is positioned between about the "8 o'clock" position and about the "10 o'clock" position, such as at about the "9 o'clock" position, to detect when paddle 230 is at or near its lowest center of gravity where paddle 230 oscillates and magnetic sensor 250B may be positioned between about the "5 o'clock" position and about the "8 o'clock" position, such as at about the "7 o'clock" position, to detect when paddle 230 falls away from driving member 217. Similarly, where one magnetic sensor 250A is used, if magnet 240 is offset 180 degrees from paddle 230, magnetic sensor 250A is positioned between about the "11 o'clock" position and about the "1 o'clock" position, such as at about the "12 o'clock" position, to detect when paddle 230 is at or near its lowest center of gravity where paddle 230 oscillates. Further, instead of using two magnetic sensors 250A, 250B to detect the motion of one magnet 240, it will be appreciated that a single magnetic sensor 250 may detect the motion of a pair of angularly offset magnets 240. In this embodiment, one or both of the magnets 240 may be positioned on an arm or extension connected to paddle 230 to rotate with paddle 230.

The shape, architecture and configuration of toner cartridge 200 shown in FIGS. 4 and 5 are meant to serve as examples and are not intended to be limiting. For instance, although the example image forming device discussed above includes a pair of mating replaceable units in the form of toner cartridge 200 and imaging unit 300, it will be appreciated that the replaceable unit(s) of the image forming device may employ any suitable configuration as desired. For example, in one embodiment, the main toner supply for the image forming device, toner adder roll 304, developer roll 306 and photoconductive drum 310 are housed in one replaceable unit. In another embodiment, the main toner supply for the image forming device, toner adder roll 304 and developer roll 306 are provided in a first replaceable unit and photoconductive drum 310 is provided in a second replaceable unit.

Although the example embodiments discussed above utilize a falling paddle in the reservoir of the toner cartridge, it will be appreciated that a falling paddle, such as paddle 230, having a magnet may be used to determine the toner level in any reservoir or sump storing toner in the image forming device such as, for example, a reservoir of the imaging unit or a storage area for waste toner. Further, although the example embodiments discussed above discuss a system for determining a toner level, it will be appreciated that this system and the methods discussed herein may be used to determine the level of a particulate material other than toner such as, for example, grain, seed, flour, sugar, salt, etc.

Although the examples above discuss the use of one or two magnetic sensors, it will be appreciated that more than two magnetic sensors may be used as desired in order to obtain more information regarding the movement of the falling paddle having the magnet. Further, while the examples discuss sensing a magnet using a magnetic sensor, in another embodiment, an inductive sensor, such as an eddy current sensor, or a capacitive sensor is used instead of a magnetic sensor. In this embodiment, the falling paddle includes an electrically conductive element detectable by the inductive or capacitive sensor. As discussed above with respect to magnet 240, the metallic element may be attached to the falling paddle by a friction fit, adhesive, fastener(s), etc. or the falling paddle may be composed of a metallic material or the metallic element may be positioned on an arm or extension that is rotatable with the falling paddle. In another alternative, the falling paddle includes a shaft that extends to an outer portion of body 204, such as through wall 206 or 207. An encoder wheel or other form of encoder device is attached or formed on the portion of the shaft of the falling paddle that is outside reservoir 202. A code reader, such as an infrared sensor, is positioned to sense the motion of the encoder device (and therefore the motion of the falling paddle) and in communication with controller 102 or another processor that analyzes the motion of the falling paddle in order to determine the amount of toner remaining in reservoir 202.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A method for estimating an amount of toner remaining in a reservoir of a replaceable unit for an image forming device, the method comprising:

rotating a shaft positioned in the reservoir and measuring an amount of revolution of the shaft;

pushing by the rotation of the shaft a paddle mounted on the shaft and free to fall ahead of the rotation of the shaft;

decreasing an estimate of the amount of toner remaining in the reservoir based on the measured amount of revolution of the shaft;

sensing the paddle near a lowest center of gravity of the paddle and monitoring whether a number of times the paddle is sensed near the lowest center of gravity of the paddle per revolution of the shaft increases; and adjusting the estimate of the amount of toner remaining in the reservoir when the number of times the paddle is sensed near the lowest center of gravity of the paddle per revolution of the shaft increases.

2. The method of claim 1, wherein sensing the paddle near the lowest center of gravity of the paddle includes sensing a magnetic field of a magnet connected to the paddle by a first magnetic sensor.

3. The method of claim 2, further comprising:

sensing the magnetic field of the magnet connected to the paddle by a second magnetic sensor positioned less than 180 degrees ahead of the first magnetic sensor with respect to the rotational direction of the shaft; and adjusting the estimate of the amount of toner remaining in the reservoir when a time duration of the second magnetic sensor sensing the magnetic field of the magnet during a single pass of the magnet past the second magnetic sensor falls below a predetermined threshold.

4. The method of claim 1, wherein:

decreasing the estimate of the amount of toner remaining in the reservoir based on the measured amount of revolution of the shaft includes decreasing an estimate of an amount of revolution of the shaft until the reservoir will run out of usable toner based on the measured amount of revolution of the shaft; and adjusting the estimate of the amount of toner remaining in the reservoir when the number of times the paddle is sensed near the lowest center of gravity of the paddle per revolution of the shaft increases includes adjusting the estimate of the amount of revolution of the shaft until the reservoir will run out of usable toner when the number of times the paddle is sensed near the lowest center of gravity of the paddle per revolution of the shaft increases.

5. The method of claim 4, wherein:

decreasing the estimate of the amount of revolution of the shaft until the reservoir will run out of usable toner includes decreasing an estimate of an amount of revolution of a drive motor providing rotational motion to the shaft until the reservoir will run out of usable toner; and adjusting the estimate of the amount of revolution of the shaft until the reservoir will run out of usable toner when the number of times the paddle is sensed near the lowest center of gravity of the paddle per revolution of the shaft increases includes adjusting the estimate of the amount of revolution of the drive motor providing rotational motion to the shaft until the reservoir will run out of usable toner when the number of times the paddle is sensed near the lowest center of gravity of the paddle per revolution of the shaft increases.

6. The method of claim 1, wherein decreasing the estimate of the amount of toner remaining in the reservoir based on the measured amount of revolution of the shaft includes decreasing the estimate of the amount of toner remaining in the reservoir based on an empirically determined feed rate of toner from the reservoir.

7. The method of claim 1, wherein monitoring whether the number of times the paddle is sensed near the lowest center of gravity of the paddle per revolution of the shaft increases includes:

determining when the shaft completes a revolution by measuring the revolution of a drive motor providing rotational motion to the shaft; and when the shaft completes the revolution, determining the number of times the paddle was sensed near the lowest center of gravity of the paddle during the completed revolution of the shaft.

8. The method of claim 1, further comprising determining whether the replaceable unit was recently removed from the image forming device and if the replaceable unit was recently removed from the image forming device, not adjusting the estimate of the amount of toner remaining in the reservoir when the number of times the paddle is sensed near the lowest center of gravity of the paddle per revolution of the shaft increases for a predetermined number of revolutions of the shaft after the replaceable unit was removed from the image forming device.

9. The method of claim 1, wherein adjusting the estimate of the amount of toner remaining in the reservoir includes calculating a new estimate of the amount of toner remaining in the reservoir giving weight to a present estimate of the amount of toner remaining in the reservoir and giving weight to an estimate of the amount of toner remaining in the reservoir corresponding to a present number of times the paddle was sensed near the lowest center of gravity of the paddle per revolution of the shaft.

10. An electrophotographic image forming device, comprising:

a drive motor;

a replaceable unit having:

a reservoir for storing toner;

a rotatable shaft positioned within the reservoir;

a paddle mounted on the shaft and free to fall ahead of the rotation of the shaft; and a drive element positioned to receive rotational force from the drive motor when the replaceable unit is installed in the image forming device and operatively connected to the shaft to rotate the shaft upon receiving the rotational force from the drive motor;

a sensor positioned to sense the paddle near a lowest center of gravity of the paddle; and a processor in electronic communication with the sensor and programmed to:

measure an amount of revolution of the shaft;

decrease an estimate of the amount of toner remaining in the reservoir based on the measured amount of revolution of the shaft;

monitor whether a number of times the paddle is sensed by the sensor near the lowest center of gravity of the paddle per revolution of the shaft increases; and adjust the estimate of the amount of toner remaining in the reservoir when the number of times the paddle is sensed by the sensor near the lowest center of gravity of the paddle per revolution of the shaft increases.

11. The electrophotographic image forming device of claim 10, further comprising a magnet connected to the paddle, wherein the sensor is a magnetic sensor positioned to sense a magnetic field of the magnet when the paddle passes near the lowest center of gravity of the paddle.

12. The electrophotographic image forming device of claim 11, further comprising a second magnetic sensor positioned less than 180 degrees ahead of the first magnetic sensor with respect to the rotational direction of the shaft and positioned to sense the magnetic field of the magnet, wherein the processor is programmed to adjust the estimate of the amount of toner remaining in the reservoir when a time duration of the second magnetic sensor sensing the magnetic field of the magnet during a single pass of the magnet past the second magnetic sensor falls below a predetermined threshold.

13. The electrophotographic image forming device of claim 10, wherein:

to decrease the estimate of the amount of toner remaining in the reservoir based on the measured amount of revolution of the shaft the processor is programmed to decrease an estimate of an amount of revolution of the shaft until the reservoir will run out of usable toner based on the measured amount of revolution of the shaft; and to adjust the estimate of the amount of toner remaining in the reservoir when the number of times the paddle is sensed by the sensor near the lowest center of gravity of the paddle per revolution of the shaft increases the processor is programmed to adjust the estimate of the amount of revolution of the shaft until the reservoir will run out of usable toner when the number of times the paddle is sensed by the sensor near the lowest center of gravity of the paddle per revolution of the shaft increases.

14. The electrophotographic image forming device of claim 13, wherein:

to decrease the estimate of the amount of revolution of the shaft until the reservoir will run out of usable toner based on the measured amount of revolution of the shaft the processor is programmed to decrease an estimate of an amount of revolution of the drive motor until the reservoir will run out of usable toner; and to adjust the estimate of the amount of revolution of the shaft until the reservoir will run out of usable toner when the number of times the paddle is sensed by the sensor near the lowest center of gravity of the paddle per revolution of the shaft increases the processor is programmed to adjust the estimate of the amount of revolution of the drive motor until the reservoir will run out of usable toner when the number of times the paddle is sensed by the sensor near the lowest center of gravity of the paddle per revolution of the shaft increases.

15. The electrophotographic image forming device of claim 10, wherein to decrease the estimate of the amount of toner remaining in the reservoir based on the measured amount of revolution of the shaft the processor is programmed to decrease the estimate of the amount of toner remaining in the reservoir based on an empirically determined feed rate of toner from the reservoir.

16. The electrophotographic image forming device of claim 10, wherein to monitor whether the number of times the paddle is sensed by the sensor near the lowest center of gravity of the paddle per revolution of the shaft increases the processor is programmed:

to determine when the shaft completes a revolution by measuring the revolution of the drive motor; and when the shaft completes the revolution, to determine the number of times the paddle was sensed by the sensor near the lowest center of gravity of the paddle during the completed revolution of the shaft.

17. A controller for use with an image forming device for estimating an amount of toner remaining in a reservoir of a replaceable unit of the image forming device, comprising:

the controller programmed:

to measure an amount of revolution of a shaft in the reservoir of the replaceable unit;

to decrease an estimate of the amount of toner remaining in the reservoir based on the measured amount of revolution of the shaft;

to monitor whether a number of times a paddle mounted on the shaft in the reservoir is sensed near a lowest center of gravity of the paddle per revolution of the shaft increases; and to adjust the estimate of the amount of toner remaining in the reservoir when the number of times the paddle is sensed near the lowest center of gravity of the paddle per revolution of the shaft increases.

18. The controller of claim 17, wherein to decrease the estimate of the amount of toner remaining in the reservoir based on the measured amount of revolution of the shaft the controller is programmed to decrease the estimate of the amount of toner remaining in the reservoir based on an empirically determined feed rate of toner from the reservoir.

19. The controller of claim 17, wherein to monitor whether the number of times the paddle mounted on the shaft in the reservoir is sensed near the lowest center of gravity of the paddle per revolution of the shaft increases the controller is programmed:

to determine when the shaft completes a revolution by measuring the revolution of a drive motor providing rotational motion to the shaft; and when the shaft completes the revolution, to determine the number of times the paddle was sensed near the lowest center of gravity of the paddle during the completed revolution of the shaft.

20. A controller for use with an image forming device for estimating an amount of toner remaining in a reservoir of a replaceable unit of the image forming device, comprising:

the controller programmed:

to receive pulses from a sensor of an encoder device measuring rotation of a drive motor that provides rotational motion to a shaft in the reservoir of the replaceable unit when the replaceable unit is installed in the image forming device;

to decrement an estimate of the number pulses from the sensor remaining until the reservoir will run out of useable toner for each pulse received from the sensor;

to monitor whether the shaft in the reservoir of the replaceable unit has completed a revolution based on the number of pulses received from the sensor;

when the controller determines that the shaft in the reservoir of the replaceable unit has completed a revolution, to send a request to a processor of the replaceable unit for a count of a number of passes of a paddle in the reservoir of the replaceable unit near a lowest center of gravity of the paddle during the completed revolution of the shaft and to receive from the processor of the replaceable unit the count of the number of passes of the paddle in the reservoir of the replaceable unit near the lowest center of gravity of the paddle during the completed revolution of the shaft;

to determine whether the count of the number of passes of the paddle in the reservoir of the replaceable unit near the lowest center of gravity of the paddle per revolution of the shaft has increased; and to adjust the estimate of the number pulses from the sensor remaining until the reservoir will run out of useable toner when the count of the number of passes of the paddle in the reservoir of the replaceable unit near the lowest center of gravity of the paddle per revolution of the shaft increases.

* * * * *